US005447831A

United States Patent [19]

Singer et al.

[11] Patent Number: 5,447,831

[45] Date of Patent: Sep. 5, 1995

[54] PHOTOGRAPHIC ELEMENT EMPLOYING HUE CORRECTION COUPLERS

[75] Inventors: Stephen P. Singer, Spencerport; Jared B. Mooberry, Rochester, both of N.Y.

[73] Assignee: Eastman Kodak Company, Rochester, N.Y.

[21] Appl. No.: 139,238

[22] Filed: Oct. 19, 1993

[51] Int. Cl.[6] ..... G03C 1/46

[52] U.S. Cl. ..... 430/504; 430/507; 430/517; 430/357; 430/359; 430/554; 430/555; 430/558

[58] Field of Search ..... 430/504, 359, 554, 555, 430/558, 357, 507, 517

[56] References Cited

U.S. PATENT DOCUMENTS

| | | | |
|---|---|---|---|
| 4,105,656 | 8/1978 | Nakamura et al. | 260/239.9 |
| 4,952,487 | 8/1990 | Renner et al. | 430/554 |
| 4,977,072 | 12/1990 | Renner et al. | 430/504 |

FOREIGN PATENT DOCUMENTS 529784 3/1993 European Pat. Off. .

*Primary Examiner*—Charles L. Bowers, Jr.
*Assistant Examiner*—Geraldine Letscher
*Attorney, Agent, or Firm*—Arthur E. Kluegel

[57] ABSTRACT

The invention provides a silver halide color negative photographic element comprising a red sensitive silver halide emulsion layer containing a coupler which reacts with oxidized color developer to form a cyan dye, a blue sensitive silver halide emulsion layer containing a coupler which reacts with oxidized color developer to form a yellow dye, and a green sensitive silver halide emulsion layer containing a coupler which upon reaction with oxidized color developer forms a magenta image dye, the element additionally comprising a hue correction coupler associated with a green sensitive layer which coupler reacts with oxidized developer to form a magenta dye having a peak absorption between 565–600 nm so that the element has a D580/D550 ratio which is greater than that exhibited by the element absent the hue correction coupler. The invention also provides a process for forming an image in the element described.

25 Claims, No Drawings

PHOTOGRAPHIC ELEMENT EMPLOYING HUE CORRECTION COUPLERS

FIELD OF THE INVENTION

This invention relates to color negative photographic elements exhibiting enhanced printer compatibility containing a hue correction coupler which produces a dye of peak absorbance of 565–600 nm after reaction with oxidized developer.

BACKGROUND OF THE INVENTION

The color negative-positive photographic system relies on the exposure of a scene onto a color negative film. The exposed negative is then projected onto a negative-working color photographic paper to form, after development, the desired positive image. In order to correctly expose the photographic paper, the average density of the negative in all three color records (red, green and blue) must be measured so that the exposure time and balance between the amounts of the R, G and B light used to expose the paper can be adjusted.

The general practice in the photofinishing industry is to read the average color density of the negative using red, green and blue filters. There is no uniform standard for these filters. Different sets of filters may read the same negative differently because of variations in the amount of light they pass. In most cases, this is not a problem since the response of a printer filter set is accounted for in the calculation for the subsequent exposure of the paper. However, this method assumes that the measured red, green and blue densities of any and all negatives to be printed by a particular printer system reflects the color balance of the original scene.

Pyrazolotriazoles have been used as magenta couplers in commercially available color negative films and can offer useful photographic advantages such as high coupling efficiency, formaldehyde insensitivity and low unwanted absorbance, even though they have high pH sensitivity and complicated syntheses. The hues of the magenta dyes formed from pyrazolotriazoles are broad in terms of bandwidth, with substantial density at wavelengths from 565 to 600 nm. Four-equivalent 1-phenyl-3-acylamino-5-pyrazolones are also used as magenta couplers in commercially available color negative films and can offer useful photographic advantages, even though they suffer from low coupling efficiency and sensitivity to formaldehyde. The hues of the magenta dyes formed from 1-phenyl-3-acylamino-5-pyrazolones are broad in terms of bandwidth, with substantial density at wavelengths from 560 to 590 nm, similar to pyrazolotriazole based dyes.

1-Phenyl-3-anilino-5-pyrazolones are also used as magenta couplers in commercially available color negative films and can offer useful photographic advantages such as low pH sensitivity, high coupling efficiency and ease of synthesis. However, the hues of the magenta dyes formed from 1-phenyl-3-anilino-5-pyrazolones are associated with narrower bandwidths than those formed from pyrazolotriazoles or 1-phenyl-3-acylamino-5-pyrazolones, with much less density at wavelengths from 565 to 600 nm. Although the foregoing numbers may vary depending on the particular color developer used, for most color developers they will be within a few nanometers. In the present application, all of the wavelength measurements given are with reference to development of the element with 2-[(4-amino-3-methyl phenyl)ethylamino]ethanol, as typically used in the industry for development of negative films as in KODAK FLEXICOLOR II Process (British Journal of Photography Annual, 1988, pp 196–198).

Thus, negative films using each of the above types of magenta couplers can be prepared so that the red, green (measured at one wavelength, i.e. 550 nm) and blue densities are matched. Because photographic paper has a narrow peak sensitivity range of 545–555 nm and low sensitivity at greater than 565 nm, films containing any of the aforementioned magenta image couplers would appear equivalent to the paper. However, the film with the 1-phenyl-3-anilino-5-pyrazolone magenta coupler would have less density in the region of 565 to 600 nm than the others. Printers whose green filters do not significantly read densities at wavelengths greater than 565 nm would record all three films as having the same green density. Printers with green filters that read density at wavelengths longer than 565 nm, however, would measure the film containing a 1-phenyl-3-anilino-5-pyrazolone as having less green density than the others. Since the red and blue density determination by the printer are relatively independent of the magenta coupler, such a printer would not give the film containing the 1-phenyl-3-anilino-5-pyrazolone the same exposure as the films with the other magenta couplers. Thus, paper images printed from a film containing 1-phenyl-3-anilino-5-pyrazolone magenta coupler would not have the same color balance on this type of printer as films containing either of the other two types of magenta couplers. For example, commercially used printers such as KODAK Printer Models 2610 or 3510 have green filters that do not read significant amounts of density at greater than 565 nm and so are not as sensitive to magenta dye absorption differences in the 565–600 nm range. However, other commercially available printers such as the KODAK Class 35 Printer, AGFA MSP Printer or the NORITSU 1001 Minilab have green filters that will read films with these different classes of couplers as different in overall green density.

In order to get color prints with matched color balance from films containing each of these three magenta couplers when printed using printers that read significant amounts of density from 565 to 600 nm, photofinishers must either segregate the different films so that the correct calculation of the exposure for that particular film can be made, or manually adjust the color balance during the printing operation. These operations are undesirable, leading to higher operating costs, decreased printer output and increased chance of operator error.

U.S. application Ser. No. 08/075,068 filed Jun. 10, 1993, describes the use of photographically inert colorants with peak absorbance of 560–590 nm to improve the printer compatibility between multilayer films that contain magenta image dyes with low absorbance between 560–590 nm compared to film containing other types of magenta dyes. However, this method is limited because the correction is not imagewise. The amount of density between 560–590 nm provided by the inert dye is fixed and constant throughout the exposure scale. At high exposures (high amounts of magenta dye), the amount of correction will be insufficient, whereas at low exposures (low amounts of magenta dye), the correction will be excessive. Only at one point in the exposure scale will the degree of correction be ideal.

EP 0 529 784 A1 describes the combination of a 4-phenylazo-1-pentachlorophenyl-3-anilino-5-pyrazolone masking coupler with photographically inert dyes having peak absorbance of 590-610 nm to improve printer compatibility. As indicated, the degree of hue correction from the inert dye will be non-linear. 1-Pentachlorophenyl-3-anilino-5-pyrazolone masking couplers produce a bathochromic dye relative to analogous 1-trichlorophenyl-3-anilino-5-pyrazolones that are typically used as magenta image couplers, but are still insufficiently bathochromic to produce enough density in the 565–600 nm region to provide the degree of correction necessary.

It would be desirable to have color negative films containing 1-phenyl-3-anilino-5-pyrazolone magenta couplers or other couplers which produce a magenta image dye with low density in the 565 to 600 nm range, which can be printed in the various available printers without segregating them from other films or manually adjusting color balance, and still obtain paper prints with good color balance.

SUMMARY OF THE INVENTION

The invention provides a silver halide color negative photographic element comprising a red sensitive silver halide emulsion layer containing a coupler which reacts with oxidized color developer to form a cyan dye, a blue sensitive silver halide emulsion layer containing a coupler which reacts with oxidized color developer to form a yellow dye, and a green sensitive silver halide emulsion layer containing a coupler which upon reaction with oxidized color developer forms a magenta image dye, the element additionally comprising a hue correction coupler associated with a green sensitive layer which coupler reacts with oxidized developer to form a magenta dye having a peak absorption between 565–600 nm so that the element has a D580/D550 ratio which is greater than that exhibited by the element absent the hue correction coupler. The invention also provides a process for forming an image in the element described.

The green density of the photographic element of the invention appears to printers with green filters that read density at wavelengths longer than 565 nm to be more like films containing pyrazolotriazole or 1-phenyl-3-acylamino-5-pyrazolone couplers. Thus, such films of the present invention are more compatible during printing operations on any printer, together with films containing other classes of magenta couplers.

DETAILED DESCRIPTION OF THE INVENTION

As used herein with reference to photographic printers, "more compatible" means that films of the invention will give closer responses to films using other magenta couplers as described above (such as 1-phenyl-3-acylamino-5-pyrazolone magenta couplers) in terms of green density, regardless of the type of printer or green filter used within. This in turn implies that the final paper image formed from the different film negatives will be more alike in overall color balance.

The element of the invention comprises a hue correction coupler which produces a dye having a peak absorption between 565–600 nm (preferrably 565–590) so that the negative has a D580/D550 ratio which is greater than exhibited by the element absent the hue correction coupler. By D580, D550, D640 and the like, is meant the density at 580 nm, 550 nm, 640 nm and the like, of the element. Unless otherwise indicated, it will be understood that the foregoing and other density values are measured at a "neutral midscale exposure" of the film. For the purposes of this application, neutral midscale exposure refers to a neutral (that is, all three color records) exposure at +0.82 logE exposure units over the ISO speed of the element. This approximates the average density region (often referred to as a midscale exposure) of a correctly exposed negative.

The present invention has particular application in color photographic negatives of the foregoing type wherein D580/D550 of the element at neutral midscale exposure, absent the hue correction coupler, is 0.75 or less (particularly where D580/D550 is 0.65 or less or is even 0.60 or less). This is indicative of insufficient density in the 565–600 nm range. The hue correction coupler should provide an increase of D580/D550 of at least 0.01, and preferably at least 0.04 (and more preferably at least 0.10). The hue correction coupler should produce a dye that is not decolorized or removed during photographic processing of the negative. The half bandwidth ("HBW") of the dye formed from the hue correction coupler can be 20–150 nm, preferably between 40-125 nm. "HBW" is the width of the absorption peak at ½ maximum height. It is also preferred to keep any increase in red density which may be derived by the unwanted absorbance of the hue correction coupler to a minimum. In this regard, it is preferred that any increase of D640/D550 of the element at neutral midscale exposure, which is caused by the hue correction, is less than the amount the hue correction coupler increases D580/D550 at neutral midscale exposure.

The elements of the present invention may contain as a magenta image dye-forming coupler, a 1-phenyl-3-anilino-5-pyrazolone color coupler (either 2 or 4 equivalent). Particularly, the 1-phenyl-3-anilino-5-pyrazolone color coupler may be of the following formula (M):

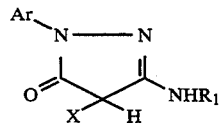

(M)

wherein:

Ar is an unsubstituted aryl group or an aryl group substituted with one or more substituents selected from halogen atoms and cyano, alkylsulfonyl, arylsulfonyl, sulfamoyl, sulfonamido, carbamoyl, carbonamido, alkoxy, acyloxy, aryloxy, alkoxycarbonyl, aryloxycarbonyl, ureido, nitro, alkyl, and trifluoromethyl, or Ar is an aryl group substituted with a group which forms a link to a polymeric chain;

$R_1$ is a substituted or unsubstituted phenyl group, the $R_1$ substituents being individually selected from halogen atoms, and alkyl, aryl, alkoxy, aryloxy, carbonamido, carbamoyl, sulfonamido, sulfamoyl, alkylsulfinyl, arylsulfinyl, alkylsulfonyl, arylsulfonyl, alkoxycarbonyl, aryloxycarbonyl, acyl, acyloxy, ureido, imido, carbamate, heterocyclic, cyano, trifluoromethyl, alkylthio, nitro, carboxyl and hydroxyl groups, provided that $R_1$ contains at least 6 carbon atoms or the $R_1$ substituents may individually comprise a group which forms a link to a polymeric chain; and X is hydrogen or a coupling-off group selected from the group consisting of halogens, alkoxy, aryloxy, alkylthio, arylthio, acyloxy, sulfonamido, carbonamido, arylazo, nitrogen-containing heterocyclic and imido groups.

Preferably, in the above formula (M):

Ar is of the structure:

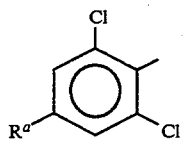

wherein $R^a$ is selected from the group consisting of halogen, cyano, alkylsulfonyl, arylsulfonyl, sulfamoyl, sulfonamido, carbamoyl, carbonamido, ureido, alkoxycarbonyl, aryloxycarbonyl, acyloxy, alkoxy, aryloxy, nitro and trifluoromethyl groups;

$—NHR_1$ is of the structure:

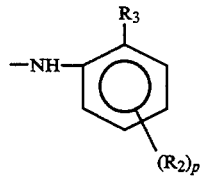

wherein p is from zero to 2 and each $R_2$ is in a meta or para position with respect to $R_3$;

each $R_2$ is individually selected from the group consisting of halogen, alkyl, alkoxy, aryloxy, carbonamido, carbamoyl, sulfonamido, sulfamoyl, alkylsulfinyl, arylsulfinyl, alkylsulfonyl, arylsulfonyl, alkoxycarbonyl, aryloxycarbonyl, acyloxy, ureido, imido, carbamate, heterocyclic, cyano, nitro, acyl, trifluoromethyl, alklythio and carboxyl groups; and $R_3$ is selected from the group consisting of hydrogen, halogen, alkyl, alkoxy, aryloxy, alkylthio, carbonamido, carbamoyl, sulfonamido, sulfamoyl, alkylsulfonyl, arylsulfonyl, alkoxycarbonyl, acyloxy, acyl, cyano, nitro and trifluoromethyl groups; and X is of the structure:

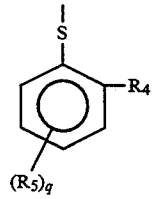

wherein $R_4$ and $R_5$ are individually selected from the group consisting of hydrogen, halogen, alkyl, alkoxy, aryloxy, carbonamido, ureido, carbamate, sulfonamido, carbamoyl, sulfamoyl, acyloxy, alkoxycarbonyl, aryloxycarbonyl, amino and carboxyl groups, and wherein q is 0, 1 or 2 and $R_5$ may be in the meta or para position with respect to the sulfur atom.

Couplers of the above type can be prepared by known methods, such as described in U.S. Pat. Nos. 4,351,897, 4,483,918, 4,555,479, 4,585,728, 4,853,319, 4,855,441, 4,929,540, 4,952,487, EP 0 257 451, and UK 1 494 777.

It is preferred that the hue correction coupler and its subsequent dye be non-diffusible, that is during long term storage it preferably remains in the layer in which it is coated. This can be accomplished, for example, by ballasting the dye or attaching it to a polymeric backbone. The range of density at 580 nm provided by the hue correction coupler should be between 0.001 and 2.0, preferably between 0.005 and 1.0 with values in the range of 0.2 to 0.3 being typical. Generally, the levels for the hue correction coupler would be between about 0.0002 $g/m^2$ to 2 $g/m^2$, or 0.002 $g/m^2$ to 1.5 $g/m^2$, or more preferably 0.01 to 1 $g/m^2$. The hue correction coupler can be located anywhere in the film element, but is preferably located in, or adjacent to, a green sensitive layer. When two or more layers of different sensitivity to green light are present, it is preferred that the hue correction coupler is present at least, but not necessarily exclusively, in the less sensitive layers. Any other type of coupler such as masking couplers, development inhibitor releasing couplers, bleach accelerator releasing couplers, etc known in the art may also be present along with the hue correction coupler.

The hue correction coupler can also release any photographically useful group known in the art upon reaction with oxidized developer and thus, serve additional functions beyond hue correction. Examples of photographically useful groups include, but are not limited to, development inhibitors, either directly or indirectly through a timing group, azo groups, bleach accelerators, development accelerators, electron transfer agents, bleach inhibitors, etc.

The hue correction coupler can be incorporated into photographic films of the present invention by any method known in the art, such as oil in water dispersions, polymers, solid particles or latexes such as described in Research Disclosure I identified later in this application. The color correction coupler may also be co-dispersed with another coupler. It should also be appreciated that the peak absorbance of the dye formed from a hue correction coupler may be highly dependent on environment, and as such, may be manipulated to give the desired density requirements by appropriate choice of coupler solvent, addenda, and dispersion conditions.

Preferred structures of hue correction couplers are shown in FORMULAS I to VII.

FORMULA I (5-PYRAZOLONES):

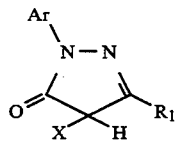

where:

Ar is a unsubstituted aryl group or an aryl group substituted with one or more substituents selected from halogen atoms and cyano, alkylsulfonyl, arylsulfonyl, sulfamoyl, sulfonamido, carbamoyl, carbonamido, alkoxy, acyloxy, aryloxy, alkoxycarbonyl, aryloxycarbonyl, ureido, nitro, alkyl, and trifluoromethyl, or Ar is an aryl group substituted with a group which forms a link to a polymeric chain. The aryl group is typically a phenyl or napthyl group or is a heteroaryl group such as pyridyl or quinolyl.

A preferred Ar group is phenyl containing at least 2 chlorine atoms, particulary 2,5-dichlorophenyl, 2,4,6-trichlorophenyl or pentachlorophenyl.

$R_1$ in this formula is any substitutent with a para Hammett constant value ($\sigma p$) of zero or greater; i.e. more electron-withdrawing than hydrogen. Suitable substitutents may be, but are not limited to, —C(O)$NR_2R_3$ or —$CR_2R_3ZR_4$ where Z is a heteroatom such as nitrogen or sulfur and $R_2$, $R_3$ and $R_4$ are independently hydrogen, substituted or unsubstituted alkyl, aryl, sulfonyl, amino or acyl groups; —$CONHR_2$; —$CONR_2R_3$; $CO_2R_2$; —$COR_2$; cyano; —$NR_2COC_xF_{(2x+1)}$ where x=1–12; —$NHSO_2R_5$ where $R_5$ is a substituted or unsubstituted alkyl, aryl or amino group; —$OCONR_2R_3$ or imido such as succimido.

It is preferred that the Hammett $\sigma p$ value be at least 0.10 or more preferably, at least 0.20. Two preferred substitutents are —$CONR_2R_5$ and —$CO_2R_2$.

X is a hydrogen atom or any coupling-off group known in the art such as halogen, alkoxy, aryloxy, alkylthio, arylthio, acyloxy, sulfonamido, carbonamido, arylazo, nitrogen-containing heterocyclic and imido groups, and heterocylic thiols such as mecaptotetrazoles or thiaoxadiazoles.

Useful coupling-off groups include substituted thiophenols such as:

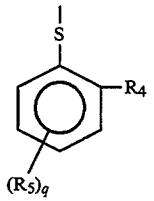

wherein $R_4$ and $R_5$ are individually selected from the group consisting of hydrogen, halogen, alkyl, alkoxy, aryloxy, carbonamido, ureido, carbamate, sulfonamido, carbamoyl, sulfamoyl, acyloxy, alkoxycarbonyl, aryloxycarbonyl, amino and carboxyl groups, and wherein q is 0, 1 or 2 and $R_5$ may be in the meta or para position with respect to the sulfur atom, N-substituted mercaptotetrazoles such as N-phenyl or N-(propoxycarbonyl)methyl mercaptotetrazole, substituted arylazo groups such as p-methoxylphenylazo or nitrogen heterocycles such as pyrazole.

The combination of Ar and $R_1$ are chosen to give a dye with $\lambda_{max}$ of 565–600 nm after development.

FORMULA Ii (3-(N-ACYL)ANILINo-5-PYRAZOLONES):

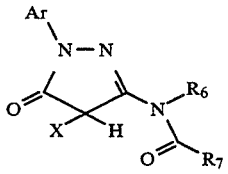

where:

Ar and X are as previously defined for Formula (M);

$R_6$ is a unsubstituted or substituted alkyl or phenyl group the substituents of $R_6$ being individually selected from halogen atoms, and alkyl, aryl, alkoxy, aryloxy, carbonamido, carbamoyl, sulfonamido, sulfamoyl, alkylsulfinyl, arylsulfinyl, alkylsulfonyl, arylsulfonyl, alkoxycarbonyl, aryloxycarbonyl, acyl, acyloxy, ureido, imido, carbamate, heterocyclic, cyano, trifluoromethyl, alkylthio, nitro, carboxyl and hydroxyl groups, provided that $R_6$ contains at least 6 carbon atoms or the $R_6$ substituents may individually comprise a group which forms a link to a polymeric chain. Suitably, $R_6$ has the formula:

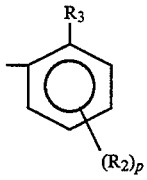

wherein p is from zero to 2 and each $R_2$ is in a meta or para position with respect to $R_3$;

each $R_2$ is individually selected from the group consisting of halogen, alkyl, alkoxy, aryloxy, carbonamido, carbamoyl, sulfonamido, sulfamoyl, alkylsulfinyl, arylsulfinyl, alkylsulfonyl, arylsulfonyl, alkoxycarbonyl, aryloxycarbonyl, acyloxy, ureido, imido, carbamate, heterocyclic, cyano, nitro, acyl, trifluoromethyl, alklythio and carboxyl groups; and $R_3$ is selected from the group consisting of hydrogen, halogen, alkyl, alkoxy, aryloxy, alkylthio, carbonamido, carbamoyl, sulfonamido, sulfamoyl, alkylsulfonyl, arylsulfonyl, alkoxycarbonyl, acyloxy, acyl, cyano, nitro and trifluoromethyl groups.

$R_7$ is a unsubstituted or substituted alkyl, alkoxy, aryl, aryloxy or amino group.

Preferred $R_7$ are alkyl groups with less than 12 carbon atoms such as methyl, ethyl, isobutyl, t-butyl, etc., alkoxy groups with less than 12 carbon atoms such as methoxy, 2-methoxyethoxy, 2-phenyloxyethoxy, etc or phenyl groups such as 2-chlorophenyl.

The combination of Ar and $R_6$ are chosen to give a dye with $\lambda_{max}$ of 565–600 nm after development.

FORMULA III (PYRAZOLQTRAZOLES):

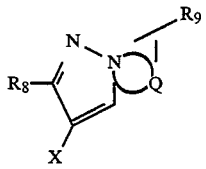

where:

X is as defined previously for Formula (I);

Q represents a group of non-metallic atoms necessary to form a nitrogen containing heterocyclic ring which has a substitutent $R_9$ $R_8$ and $R_9$ are either a substituted or unsubstituted alkyl or aryl group or any substitutent with a para Hammett constant value ($\sigma p$) of zero or greater; i.e. more electron-withdrawing than hydrogen. Suitable substitutents are, but not limited to, —$CR_2R_3ZR_4$ where Z is a heteroatom such as oxygen, nitrogen or sulfur and $R_2$, $R_3$ and $R_4$ are hydrogen, substituted or unsubstituted alkyl, aryl, sulfonyl, amino or acyl groups; —$CONHR_2$; —$CONR_2R_3$; —$CO_2R_2$; —$COR_2$; cyano; —$NR_2COC_xF_{(2x+1)}$ where x=1–12; —$NHSO_2R_5$ where $R_5$ is a substituted or unsubstituted alkyl, aryl or amino group; —$OCONR_2R_3$ or imido such as succimido.

At least one of $R_8$ or $R_9$ must be either a phenyl group or a substituent with a para Hammett constant value ($\sigma p$) of zero or greater and together provide a dye with $\lambda_{max}$ of 565–600 nm after development.

Preferred pyrazolotriazole structures (Formulas III A-H) are:

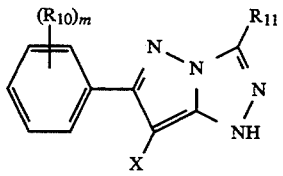

FORMULA III A

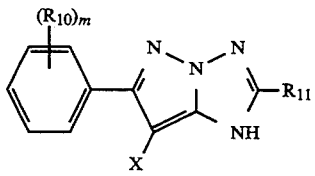

FORMULA III B

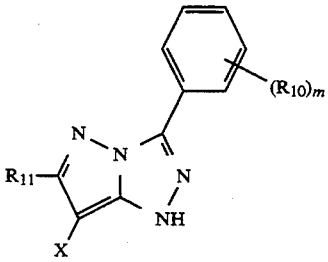

FORMULA III C

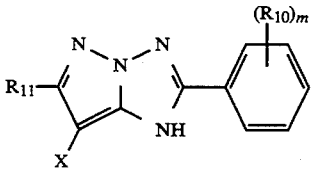

FORMULA III D

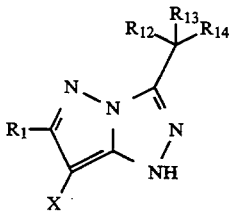

FORMULA III E

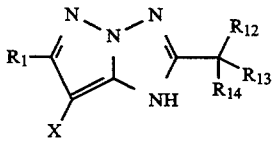

FORMULA III F

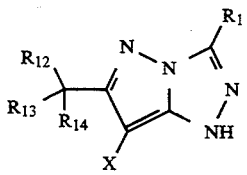

FORMULA III G

-continued

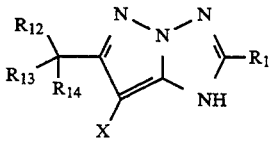

FORMULA III H where: X and $R_1$ are as defined previously for Formula (M);

$R_{10}$ is individually selected from the same group as the $R_1$ substitutents of the image coupler;

m is 0–5;

$R_{11}$ is a substituted or unsubstituted alkyl, alkyloxy, acylamino, amino or aryl group;

$R_{12}$, $R_{13}$, $R_{14}$ are each individually hydrogen or as defined as for $R_{11}$; with the proviso that the substitutents are chosen as to provide a dye with peak absorbance of 565 nm–600 nm after development.

FORMULA IV (PYRAZOLO(1,5-a)BENZIMIDAZOLES):

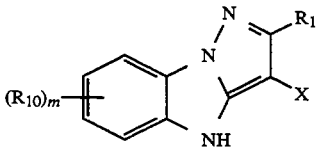

where:

$R_1$, $R_{10}$, X and m are as defined previously;

with the proviso that the substitutents are chosen as to provide a dye with peak absorbance of 565 nm–600 nm after development.

FORMULA V (IMIDAZO(1,2-b) (1,2,4)TRIAIOLES):

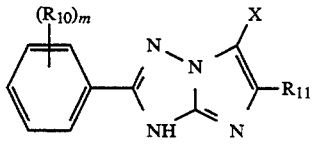

where:

X, m, $R_{10}$, and $R_{11}$ are as defined previously; with the proviso that the substitutents are chosen as to provide a dye with peak absorbance of 565 nm–600 nm after development.

FORMULA VI:

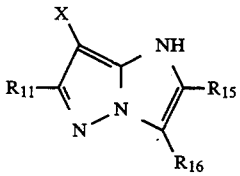

where;

X and $R_{11}$ are as defined previously;

$R_{15}$ and $R_{16}$ are each individually hydrogen or a substitutent as defined for $R_{11}$ or may be joined together to form a ring system;

with the proviso that the substitutents are chosen as to provide a dye with peak absorbance of 565 nm–600 nm after development.

A preferred example is:

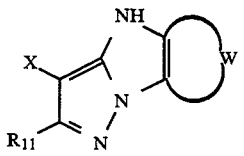

where:

W is a group of non-metallic atoms necessary to form a six member carbocyclic or heterocyclic ring which may have a substitutent;

$R_{11}$ is an acylamino group; and wherein W and $R_{11}$ are chosen as to provide a dye with λmax of 565–600 nm after development.

STRUCTURE VII (Enamines):

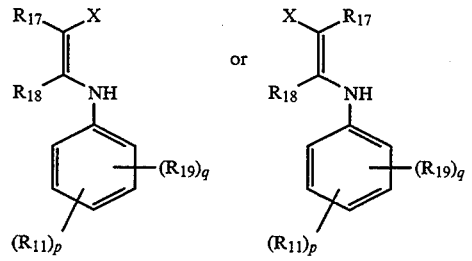

where:

X and $R_{11}$ are as previously defined; and $R_{17}$ and $R_{18}$ are each independently the same as $R_1$; (It is preferred that both $R_{17}$ and $R_{18}$ are cyano groups.)

$R_{19}$ is a substitutent with a para Hammett sigma coefficient of at least 0.3; (Preferred $R_{19}$ groups are sulfone, sulfonamide, cyano or nitro.)

q is optionally 1–5 and p is optionally 0–4 such that (q+p)is less than or equal to 5.

wherein the substitutents are chosen as to provide a dye with λmax of 565–600 nm after development.

Illustrative examples of hue correction couplers are:

HCC-1

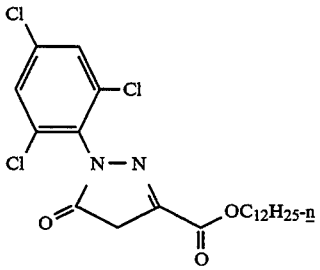

HCC-2

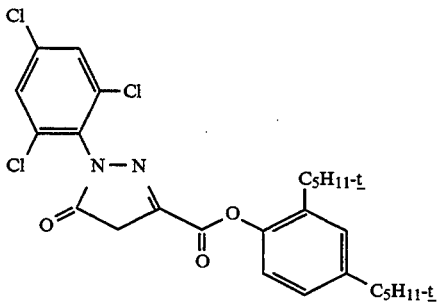

HCC-3

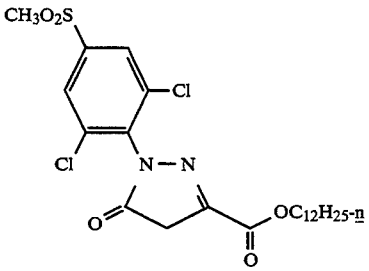

HCC-4

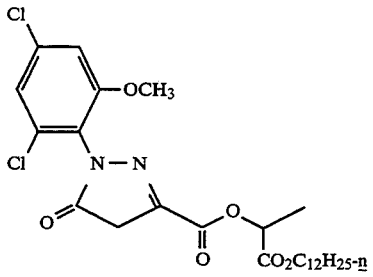

HCC-5

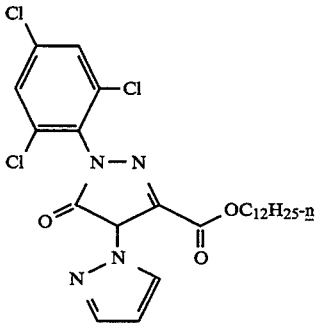

HCC-6

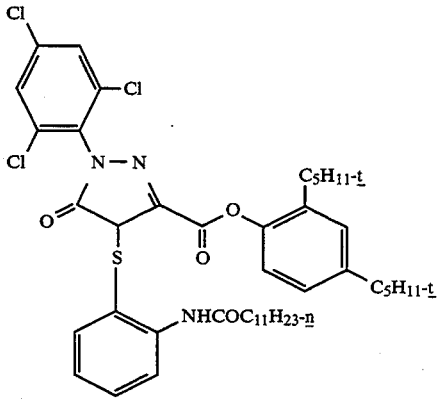

-continued
HCC-7
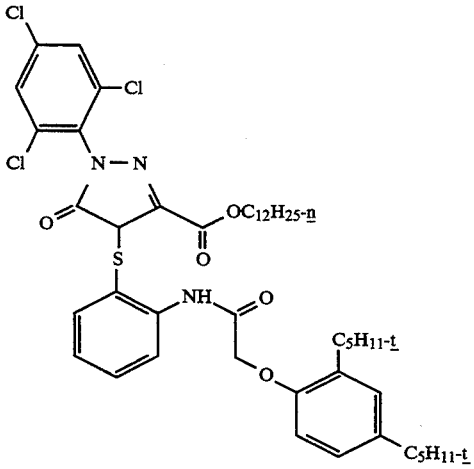
HCC-8
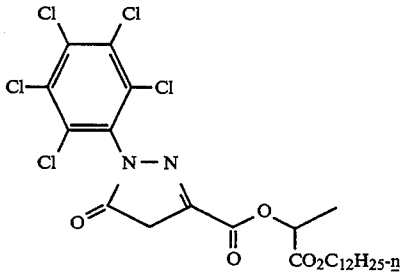
HCC-9
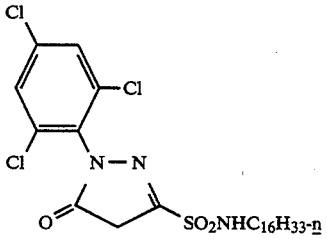
HCC-10
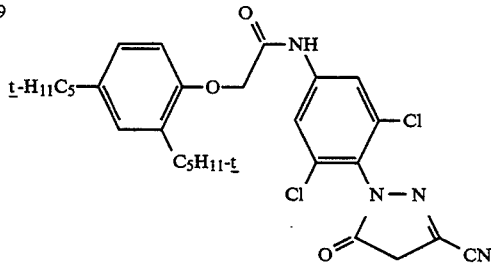
HCC-11
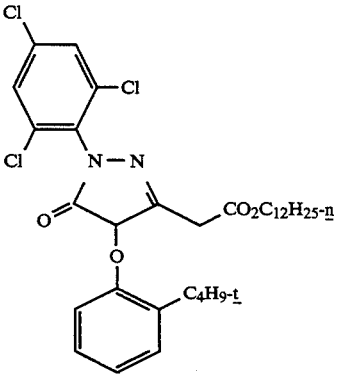
HCC-12
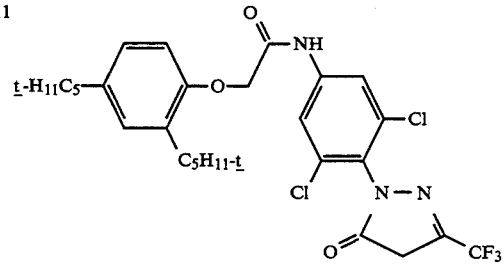
HCC-13
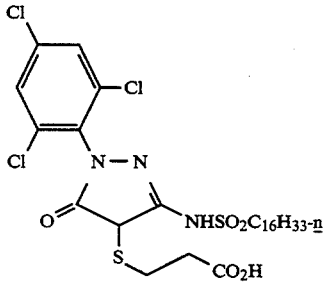
HCC-14
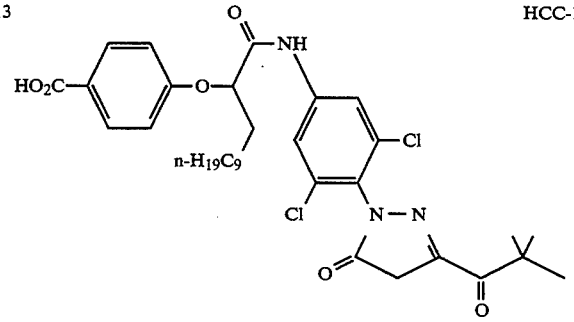

-continued
HCC-15
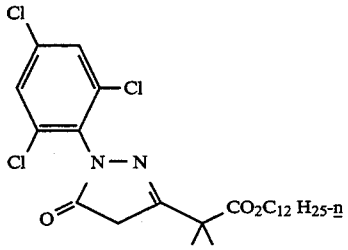
HCC-16
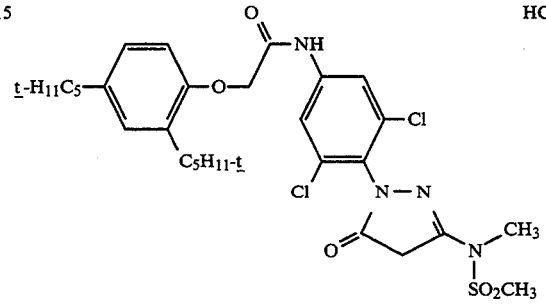
HCC-17
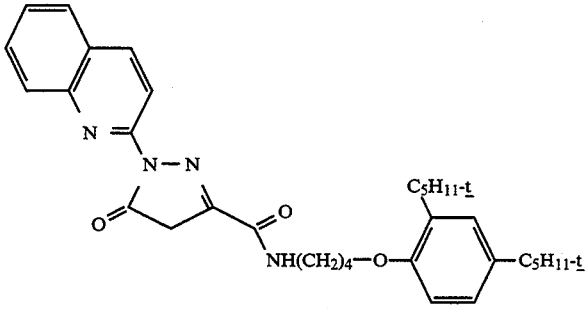
HCC-18
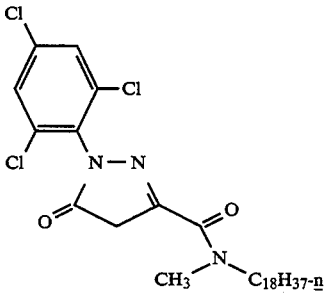
HCC-19
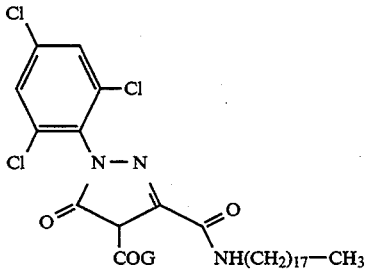
COG = H
HCC-20
COG = 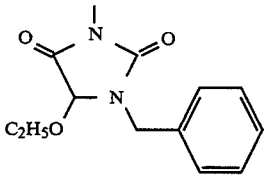
HCC-21
COG = 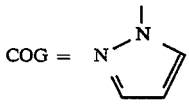
HCC-22
COG = 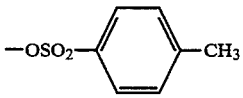
HCC-23
COG = 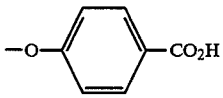
HCC-24
COG = 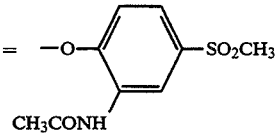
HCC-25
COG = 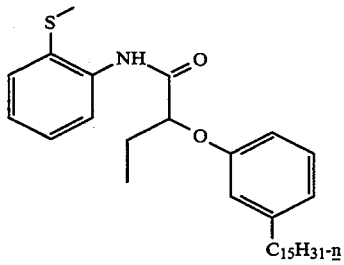

-continued
HCC-26
COG = 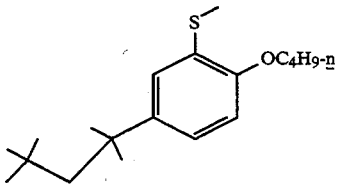
HCC-27
COG = 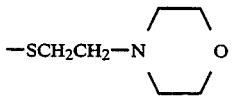
HCC-28
COG = 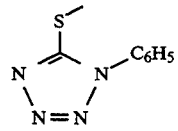
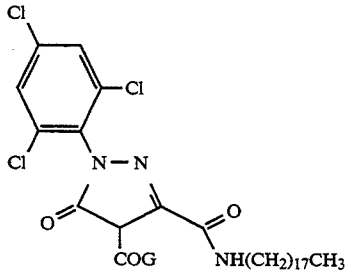
HCC-29
COG = 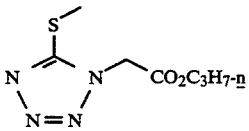
HCC-30
COG = 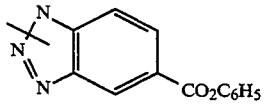
HCC-31
COG = 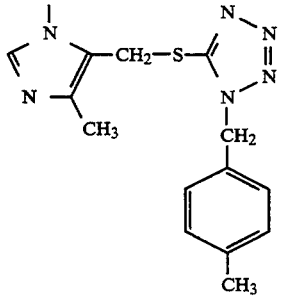
HCC-32
COG = 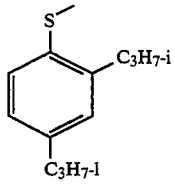
HCC-33
COG = 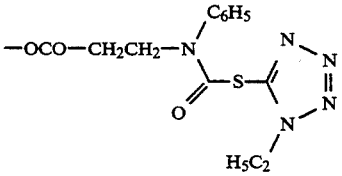
HCC-34
COG = 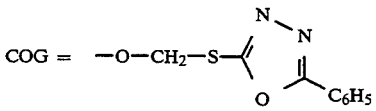
HCC-35
COG = 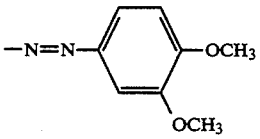
HCC-36
COG = 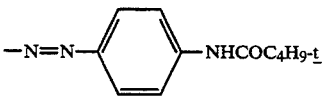

-continued
HCC-37
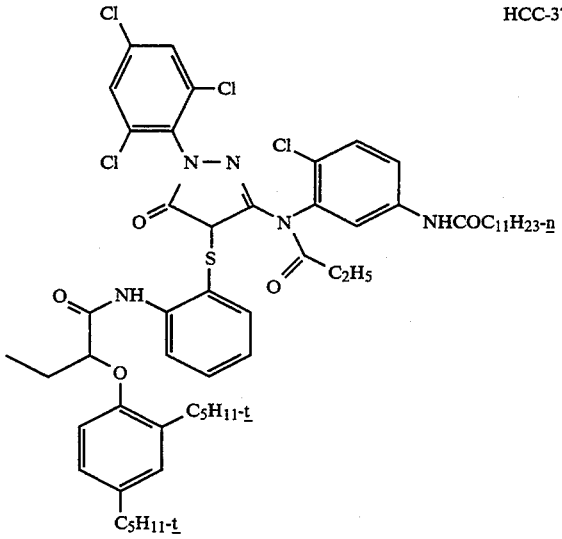
HCC-38
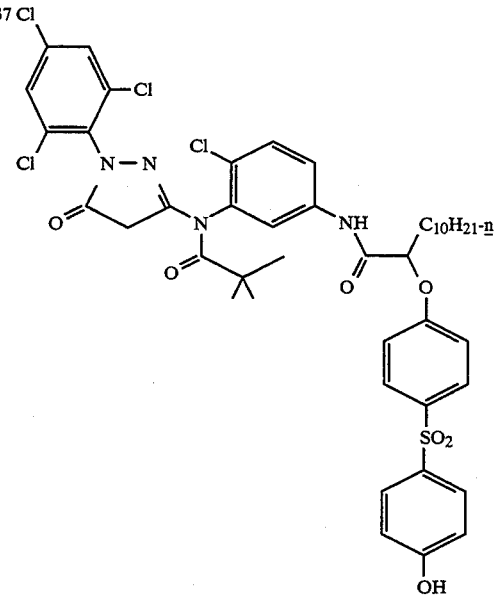
HCC-39
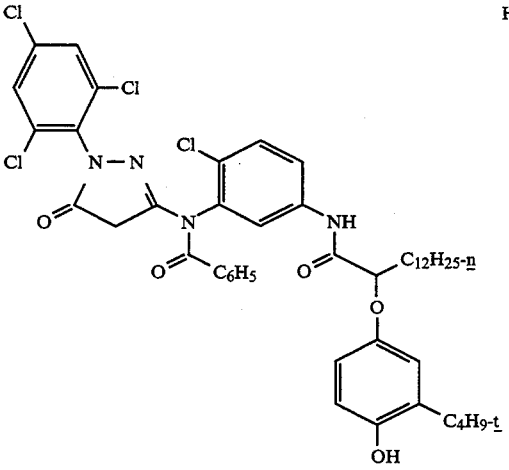
HCC-40
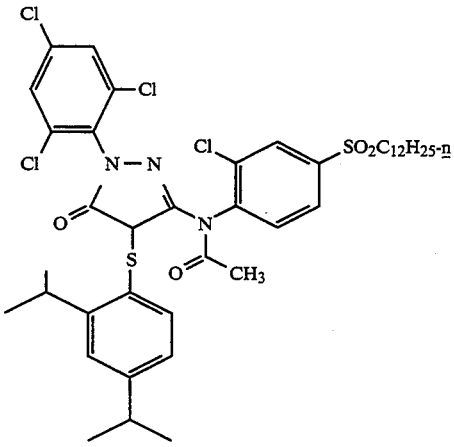
HCC-41
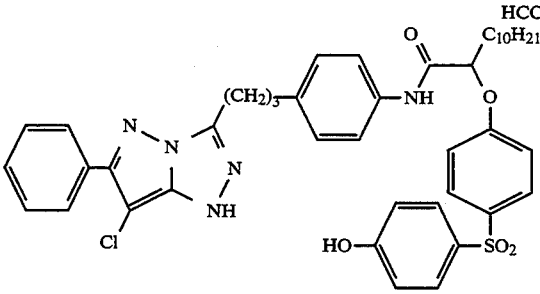
HCC-42
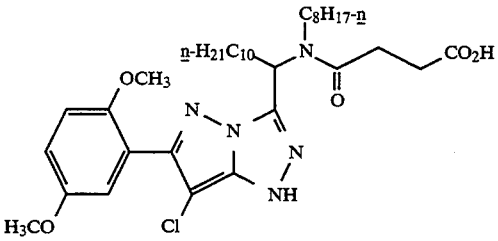
HCC-43
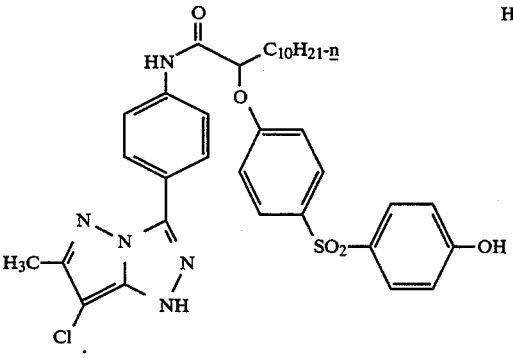
HCC-44
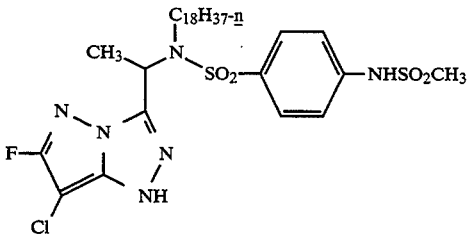

-continued
HCC-45
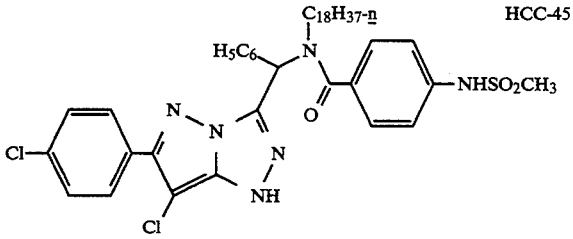
HCC-46
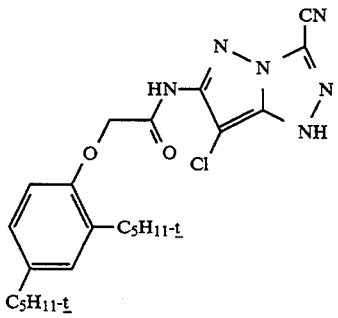
HCC-47
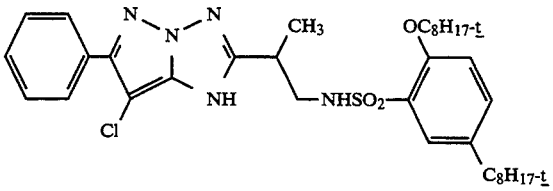
HCC-48
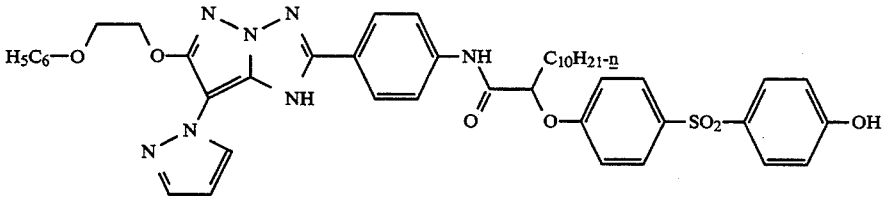
HCC-49
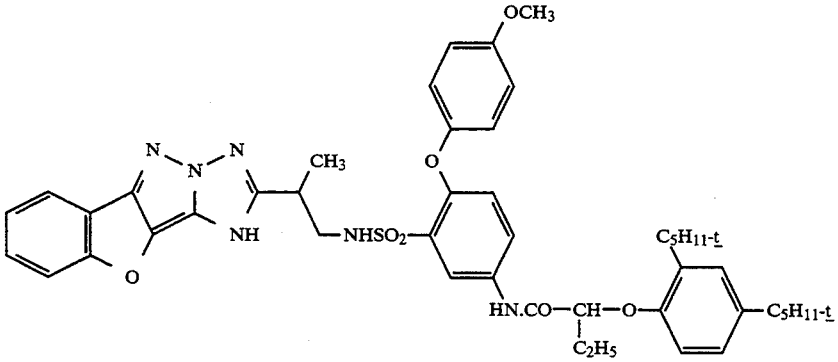
HCC-50
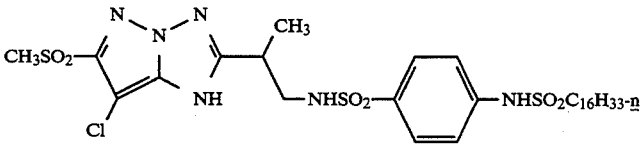
HCC-51
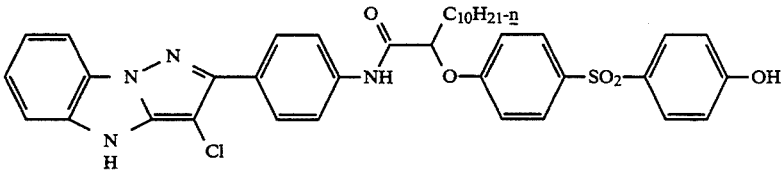

-continued

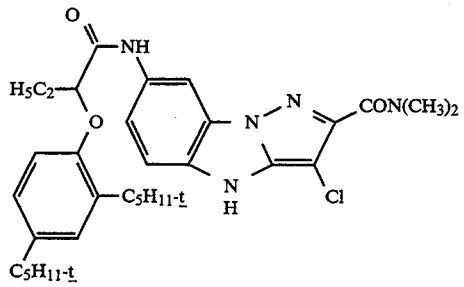

HCC-52

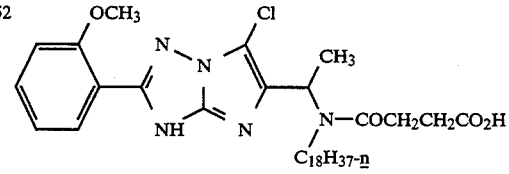

HCC-53

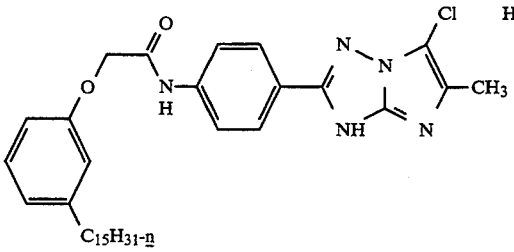

HCC-54

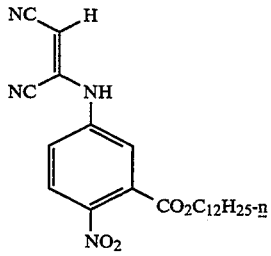

HCC-55

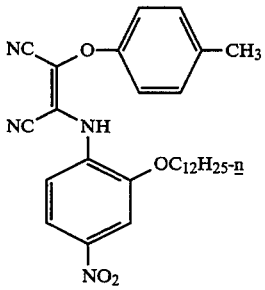

HCC-56

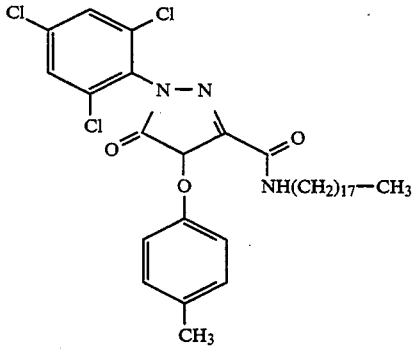

HCC-57

Compounds of the above structures can be prepared by procedures known in the art or as shown and described below.

Preparation of Coupler HCC-57:

Intermediate (A): A five-liter flask was charged with p-cresol (162 g, 1.5 mole), ethyl chloroacetate (190 g, 1.55 mole), anhydrous potassium carbonate (210 g, 1.52 mole), and 1.5 liters of acetone. The mixture was stirred mechanically while heating at reflux for 48 hours. After cooling to rt overnight, the mixture was filtered to remove insoluble potassium salts and concentrated under reduced pressure. (A) was obtained as a yellow oil (267 g, 92%).

Intermediate (B): A one-liter flask was dried under nitrogen purge and charged with sodium ethoxide (45 g, 0.61 mole), dry ethyl ether (200 ml), and diethyl oxalate (123 g, 0.84 mole). A solution of (A) (109 g, 0.56 mole) in 200 ml of dry ether was added dropwise over about one hr before refluxing the mixture for 22 hr. The mixture was poured onto 400 g of ice, acidified with about 45 ml of conc. HCl, and the ether layer was separated. After washing with water and drying, the ether solution was concentrated to crude (B) as a red oil (118 g, 72%).

Intermediate (C): Trichlorophenylhydrazine (21.1 g, 0.1 mole), crude (B) (29.4 g, 0.1 mole), and 300 ml of acetic acid were heated under reflux for 30 hr. The mixture was cooled and poured into 1.2 l of water to precipitate a gummy solid. The solid was dissolved in ethyl acetate before washing with water, dilute sodium bicarbonate, and brine. The solution was dried over $MgSO_4$ and concentrated to a semisolid mass. Crystalline product (C)(23 g, 52%) was obtained from ethyl acetate-heptane.

Intermediate (D): Pyrazolone (C)(30.9 g, 0.07 mole), sodium hydroxide (16.8 g, 0.3 mole), and 300 ml of 50% aqueous methanol were warmed gently for about an hour until conversion to the acid was complete as judged by thin layer chromatography (tlc). Cold aqueous HCl was added to precipitate the coupler carboxylic acid (D) (26 g, 93%) after filtering and drying.

Intermediate (E): A mixture of acid coupler (D) (38 g, 0.092 mole), oxalyl chloride (16 ml, 0.18 mole), drops of dimethylformamide, and 200 ml of methylene chloride was stirred at rt for about 2 hr. The mixture was then concentrated at 40 degrees under reduced pressure using methylene chloride to chase residual oxalyl chloride. Crude solid acid chloride (E) so obtained was used immediately in the next step.

HCC-57: Octadecylamine (24.2 g, 0.092 mole), lutidine (10.7ml, 0.092 mole), and 250 ml of tetrahydrofuran were stirred in a round bottom flask cooled in ice. Acid chloride (E) was added slowly with vigorous stirring. Triethylamine (15 ml) was then added and the mixture was stirred at room temperature for 15 min. The mixture was then diluted with aqueous HCl to precipitate a solid. The solid was slurried with about 200 ml of 1:1 methanol:ethyl acetate solution and filtered. The filtrate was concentrated to about 40 g of syrupy solid. The crude product was chromatographed on 450 g of silica gel using 1:1 heptane: ethyl acetate as eluent. The coupler fraction (27 g) obtained from the column was mixed with additional octadecylamine (8 g) and 20 ml of xylene and then heated at 120 degrees for about 5 min to convert residual dimeric material to product. This mixture was placed on 450 g of silica gel and eluted consecutively with 10% ethyl acetate in heptane, 90:10:1 heptane:ethyl acetate:acetic acid, and then 70:20:1 mixture of the same solvents. The product coupler obtained from the column was taken up in 300 ml of hot acetonitrile, decanted from some purplish insoluble residue, and allowed to cool to deposit crystalline coupler HCC-55 (26 g, 43%).

Preparation of Coupler HCC-19:

Intermediate (F): Ethyloxalacetate (9.4 g, 0.05 mole), trichlorphenyl-hydrazine (10.6 g, 0.05 mole), acetic acid (1 ml), and ethyl alcohol (100 ml) were heated under reflux for 3 hr. The mixture was cooled slightly before adding sodium methoxide (5.4 g, 0.1 mole) and continuing the refluxing period for 2 hr more. The mixture was cooled to rt, diluted with water, acidified with acetic acid, and cooled in an ice/salt bath. The solid was filtered off and recrystallized several times from acetonitrile to yield 10.5 g (63%) of pyrazolone (F).

Intermediate (G): Pyrazolone (F) (67 g, 0.2 mole), sodium carbonate (53 g, 0.5 mole), and 500 ml of water were heated under reflux for 3 hr to saponify the ester. The mixture was cooled and carefully acidified with aqueous HCl. After cooling overnight at 0 degrees, the solution deposited white crystalline solid pyrazolone acid (G) (47.5 g, 72%).

Intermediate (H): A mixture of acid (G) (47.5 g, 0.155 mole) and 100 ml of acetic anhydride were heated under reflux for 10 min. and then concentrated under reduced pressure at about 50 degrees to remove excess anhydride. Thionyl chloride (100 ml) was added before heating to reflux again for 20 min. Excess thionyl chloride was removed under reduced pressure before diluting the residue with 700 ml of ligroin and cooling overnight in the refrigerator. Crystalline intermediate (H) (33.6 g, 59%) was obtained.

HCC-19: A solution of octadecylamine (2.7 g, 0.01 mole) in 30 ml of acetic acid was mixed with a solution of acid chloride (H) (3.7 g, 0.01 mole) in 30 ml of acetic acid and warmed on the steam bath for a few minutes. A solution of sodium acetate (0.8 g, 0.01 mole) in 15 ml of acetic acid was added to the mixture before heating on the steam bath for 45 min. After cooling, the mixture was diluted with water to precipitate the coupler which was filtered off and treated with KOH (2 g, 0.03 mole) in 50 ml of ethanol at rt for 5 min to remove the acetyl group. The solution was acidified with acetic acid, diluted with water, and cooled to precipitate coupler HCC-19 (1.6 g, 26%) after several recrystallizations from ethanol. Larger runs were often contaminated with N-octadecylacetamide which required chromatography to remove. The schematic for the synthesis of these two coupler is as follows:

Preparation of HCC-57

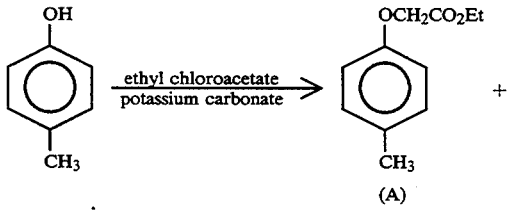

-continued

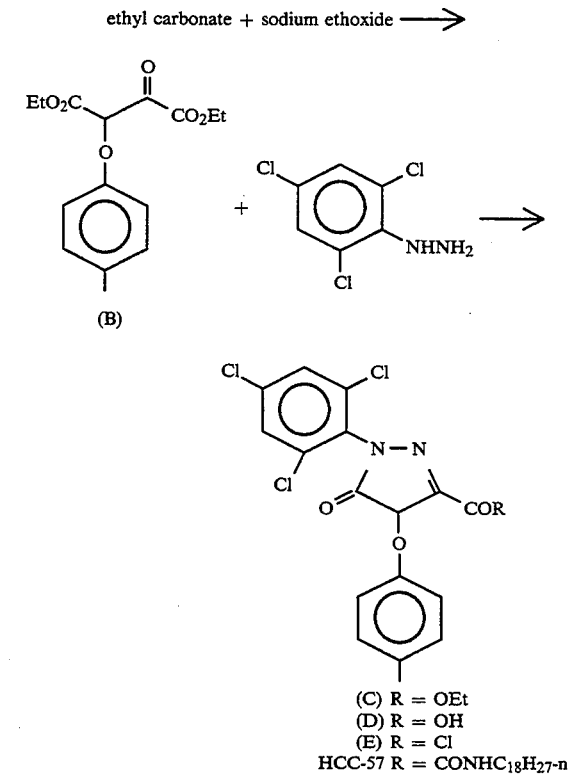

Preparation of HCC-19:

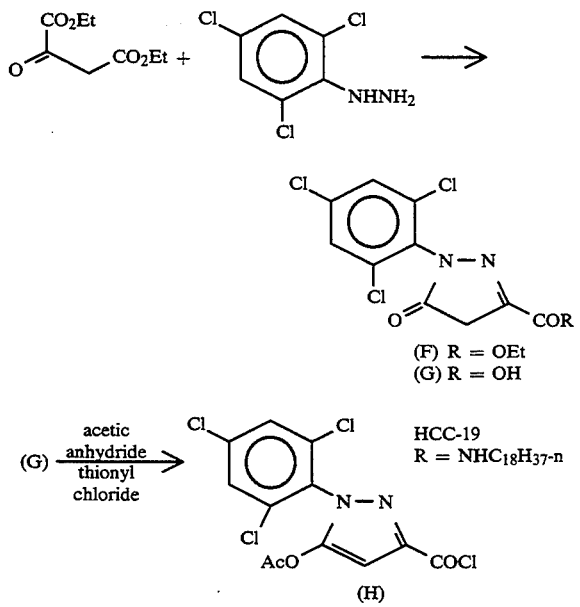

As already mentioned, the present invention provides a means to make developed negatives which contain magenta image-dyes with low absorption in the 565–600 nm range relative to magenta dyes formed by pyrazolotriazole or 1-phenyl-3-acylamino-5-pyrazolones, appear more like the latter developed negatives to any printer. Consequently, negatives of the present invention can contain any color coupler or combination of magenta couplers which forms a magenta record with relatively low absorption in the 565–600 nm range upon reaction with oxidized color developer (for example, with a D580/D550 at a neutral midscale exposure of 0.75 or less). Negative elements of the present invention particularly contain as a magenta image dye-forming coupler, a 1-phenyl-3-anilino-5-pyrazolone color coupler (either 2 or 4 equivalent). Other classes of magenta image couplers such as a pyrazolotriazole (for example, Coupler A in the Experimental Section) or a 1-phenyl-3-acylamino-5-pyrazolone coupler (for example, Coupler C) may also be present in combination with a 1-phenyl-5-anilino-5-pyrazolone (for example, Coupler B) so long as the density above 565 nm of the magenta record as a whole is still insufficient (for example, with a D580/D550 at a neutral midscale exposure of 0.75 or less) relative to films that contain pyrazolotriazoles or 1-phenyl-3-acylamino-5-pyrazolone couplers as the image coupler.

The materials of the invention can be used in any of the ways and in any of the combinations known in the art. Typically, the invention materials are incorporated in a silver halide emulsion and the emulsion coated as a layer on a support to form part of a photographic element. Alternatively, they can be incorporated at a location adjacent to the silver halide emulsion layer where, during development, they will be in reactive association with development products such as oxidized color developing agent. Thus, as used herein, the term "associated" signifies that the compound is in the silver halide emulsion layer or in an adjacent location where, during processing, it is capable of reacting with silver halide development products.

To control the migration of various components, it may be desirable to include a high molecular weight hydrophobe or "ballast" group in the component molecule. Representative ballast groups include substituted or unsubstituted alkyl or aryl groups containing 8 to 42 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arysulfonyl, sulfonamido, and sulfamoyl groups wherein the substituents typically contain 1 to 42 carbon atoms. Such substituents can also be further substituted.

The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

If desired, the photographic element can be used in conjunction with an applied magnetic layer as described in *Research Disclosure*, November 1992, Item 34390 published by Kenneth Mason Publications, Ltd., Dudley Annex, 12a North Street, Emsworth, Hampshire P010 7DQ, ENGLAND.

In the following discussion of suitable materials for use in the emulsions and elements of this invention, reference will be made to *Research Disclosure*, December 1989, Item 308119, available as described above, which will be identified hereafter by the term "Research Disclosure." The contents of the Research Disclosure, including the patents and publications referenced therein, are incorporated herein by reference, and the Sections hereafter referred to are Sections of the Research Disclosure.

The silver halide emulsions employed in the elements of this invention can be either negative-working or positive-working. Suitable emulsions and their preparation as Well as methods of chemical and spectral sensitization are described in Sections I through IV. Color materials and development modifiers are described in Sections V and XXI. Vehicles are described in Section IX, and various additives such as brighteners, antifoggants, stabilizers, light absorbing and scattering materials, hardeners, coating aids, plasticizers, lubricants and matting agents are described , for example, in Sections V, VI, VIII, X, XI, XII, and XVI. Manufacturing methods are described in Sections XIV and XV, other layers and supports in Sections XIII and XVII, processing methods and agents in Sections XIX and XX, and exposure alternatives in Section XVIII.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in U.K. Patents and published application Nos. 1,466,728, 1,531,927, 1,533,039, 2,006,755A and 2,017,704A, the disclosures of which are incorporated herein by reference.

Image dye-forming couplers may be included in the element such as couplers that form cyan dyes upon reaction with oxidized color developing agents which are described in such representative patents and publications as: U.S. Pat. Nos. 2,367,531, 2,423,730, 2,474,293, 2,772,162, 2,895,826, 3,002,836, 3,034,892, 3,041,236, 4,333,999, 4,883,746 and "Farbkuppler-eine LiteratureUbersicht," published in Agfa Mitteilungen, Band III, pp. 156–175 (1961). Preferably such couplers are phenols and naphthols that form cyan dyes on reaction with oxidized color developing agent.

Couplers that form magenta dyes upon reaction with oxidized color developing agent are described in such representative patents and publications as: U.S. Pat. Nos. 2,311,082, 2,343,703, 2,369,489, 2,600,788, 2,908,573, 3,062,653, 3,152,896, 3,519,429, and "Farbkuppler-eine LiteratureUbersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents.

Couplers that form yellow dyes upon reaction with oxidized and color developing agent are described in such representative patents and publications as: U.S. Pat. Nos. 2,298,443, 2,407,210, 2,875,057, 3,048,194, 3,265,506, 3,447,928, 4,022,620, 4,443,536, and "Farbkuppler-eine LiteratureUbersicht," published in Agfa Mitteilungen, Band III, pp. 112–126 (1961). Such couplers are typically open chain ketomethylene compounds.

Couplers that form colorless products upon reaction with oxidized color developing agent are described in such representative patents as: U.K. Patent No. 861,138; U.S. Pat. Nos. 3,632,345, 3,928,041, 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Patent Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3- position may be employed. Couplers of this type are described, for example, in U.S. Pat. Nos. 5,026,628, 5,151,343, and 5,234,800.

It may be useful to use a combination of couplers any of which may contain known ballasts or coupling-off groups such as those described in U.S. Pat. Nos. 4,301,235; 4,853,319 and 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213.490; Japanese Published Application 58-172,647; U.S. Pat. Nos. 2,983,608; 4,070,191; and 4,273,861; German Applications DE 2,706,117 and DE 2,643,965; U.K. Patent 1,530,272; and Japanese Application A-113935. The masking couplers may be shifted or blocked, if desired.

The invention materials may also be used in association with materials that accelerate or otherwise modify the processing steps e.g. of bleaching or fixing to improve the quality of the image. Bleach accelerator releasing couplers such as those described in EP 193,389; EP 301,477; U.S. Pat. Nos. 4,163,669; 4,865,956; and 4,923,784, may be useful. Also contemplated is use of the compositions in association with nucleating agents, development accelerators or their precursors (UK Patent 2,097,140; U.K. Patent 2,131,188); electron transfer agents (U.S. Pat. Nos. 4,859,578; 4,912,025); antifogging and anti color-mixing agents such as derivatives of hydroquinones, aminophenols, amines, gallic acid; catechol; ascorbic acid; hydrazides; sulfonamidophenols; and non color-forming couplers.

For example, in a color negative element, the materials of the invention may replace or supplement the materials of an element comprising a support bearing the following layers from top to bottom:

(1) one or more overcoat layers containing ultraviolet absorber(s);

(2) a two-coat yellow pack with a fast yellow layer containing "Coupler 1": Benzoic acid, 4-chloro-3((2-(4-ethoxy-2,5-dioxo-3-(phenylmethyl)-1-imidazolidinyl)-3-(4-methoxyphenyl)- 1,3-dioxopropyl)amino)-, dodecyl ester and a slow yellow layer containing the same compound together with "Coupler 2": Propanoic acid, 2-[[5-[[4-[2-[[[2,4-bis(1,1-dimethylpropyl)phenoxy]acetyl]amino]-5-[(2,2,3,3,4,4,4-heptafluoro-1-oxobutyl)amino]-4-hydroxyphenoxy]-2,3-dihydroxy-6-[(propylamino)carbonyl [phenyl]thio]-1,3,4-thiadiazol-2-yl]thio]-, methyl ester and "Coupler 3": 1-((dodecyloxy)carbonyl) ethyl(3-chloro-4-((3-(2-chloro-4-((1-tridecanoylethoxy) carbonyl)anilino)-3-oxo-2-((4)(5)(6)-(phenoxycarbonyl)-1H-benzotriazol-1-yl)propanoyl)amino))benzoate;

(3) an interlayer containing fine metallic silver;

(4) a triple-coat magenta pack with a fast magenta layer containing "Coupler 4": Benzamide, 3-((2-(2,4-bis(1,1-dimethylpropyl)phenoxy)-1-oxobutyl-)amino)-N-(4,5-dihydro-5-oxo-1-(2,4,6-trichlorophenyl)-1H-pyrazol-3-yl)-, "Coupler 5": Benzamide, 3-((2-(2,4-bis(1,1-dimethylpropyl)phenoxy)-1-oxobutyl)amino)-N-(4′,5′-dihydro-5′-oxo-1′-(2,4,6-trichlorophenyl) (1,4′-bi-1H-pyrazol)-3′-yl)-, "Coupler 6": Carbamic acid, (6-(((3-(dodecyloxy)-propyl)amino)carbonyl)-5-hydroxy-1-naphthalenyl)-, 2-methylpropyl ester, "Coupler 7": Acetic acid, ((2-((3-(((3-(dodecyloxy)propyl-)amino) carbonyl)-4-hydroxy-8-(((2-methylpropoxy)carbonyl) amino)-1-naphthalenyl)oxy)ethyl)thio)-, and "Coupler 8" Benzamide, 3-((2-(2,4-bis(1,1-dimethylpropyl) phenoxy)-1-oxobutyl)amino)-N-(4,5-dihydro-4-((4-methoxyphenyl) azo)-5-oxo-1-(2,4,6-trichlorophenyl)-1H-pyrazol-3-yl)-; a mid-magenta layer and a slow magenta layer each containing "Coupler 9": a ternary copolymer containing by weight in the ratio 1:1:2 2-Propenoic acid butyl ester, styrene, and N-[1-(2,4,6-trichlorophenyl)-4,5-dihydro-5-oxo-1H-pyrazol-3-yl]-2-methyl-2-propenamide; and "Coupler 10": Tetradecanamide, N-(4-chloro-3-((4-((4-((2,2-dimethyl-1-oxopropyl)amino)phenyl)azo)- 4,5-dihydro-5-oxo-1-(2,4,6-trichlorophenyl)-1H-pyrazol-3-yl)amino)phenyl)-, in addition to Couplers 3 and 8;

(5 ) an interlayer;

(6 ) a triple-coat cyan pack with a fast cyan layer containing Couplers 6 and 7; a mid-cyan containing Coupler 6 and "Coupler 11": 2,7-Naphthalenedisulfonic acid, 5 -(acetylamino)-3-((4-(2-((3-(((3-(2,4-bis(1,1-dimethylpropyl)phenoxy) propyl)amino)-carbonyl)-4-hydroxy-1-naphthalenyl) oxy)ethoxy)-phenyl)azo)-4-hydroxy-, disodium salt; and a slow cyan layer containing Couplers 2 and 6;

(7) an undercoat layer containing Coupler 8; and (8) an antihalation layer.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. Nos. 4,420,556; and 4,543,323.) Also, the compositions may be blocked or coated in protected form as described, for example, in Japanese Application 61/258,249 or U.S. Pat. No. 5,019,492.

The invention materials may further be used in combination with image-modifying compounds such as "Developer Inhibitor-Releasing" compounds (DIR's). DIR's useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

Such compounds are also disclosed in "Developer-Inhibitor-Rel easing (DIR) Couplers for Color Photography," C. R. Barr, J. R. Thirtle and P. W. Vittum in *Photographic Science and Engineering*, Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

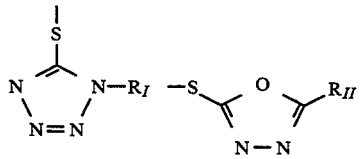

-continued

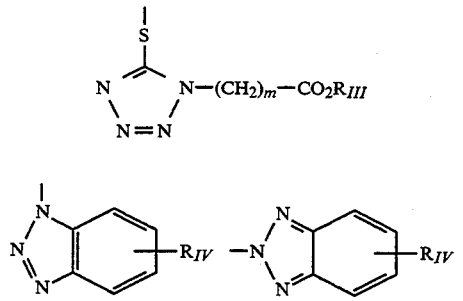

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and $—SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, $—COOR_V$ and $—NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

As mentioned, the developer inhibitor-releasing coupler may include a timing group which produces the time-delayed release of the inhibitor group such as groups utilizing the cleavage reaction of a hemiacetal (U.S. Pat. No. 4,146,396, Japanese Applications 60-249148; 60-249149); groups using an intramolecular nucleophilic substitution reaction (U.S. Pat. No. 4,248,962); groups utilizing an electron transfer reaction along a conjugated system (U.S. Pat. Nos. 4,409,323; 4,421,845; Japanese Applications 57-188035; 58-98728; 58-209736; 58-209738) groups utilizing ester hydrolysis (German Patent Application (OLS) No. 2,626,315; groups utilizing the cleavage of imino ketals (U.S. Pat. No. 4,546,073); groups that function as a coupler or reducing agent after the coupler reaction (U.S. Pat. Nos. 4,438,193; 4,618,571) and groups that combine the features describe above. It is typical that the timing group or moiety is of one of the formulas:

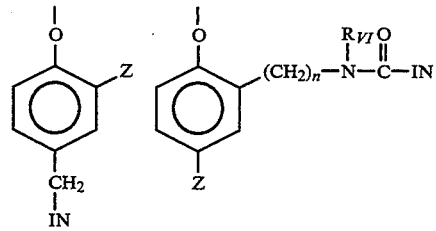

wherein IN is the inhibitor moiety, Z is selected from the group consisting of nitro, cyano, alkylsulfonyl; sulfamoyl ($—SO_2NR_2$); and sulfonamido ($—NRSO_2R$)

groups; n is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

Suitable developer inhibitor-releasing couplers for use in the present invention include, but are not limited to, the following:

D1

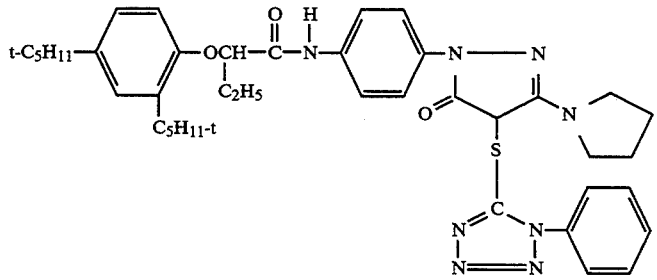

D2

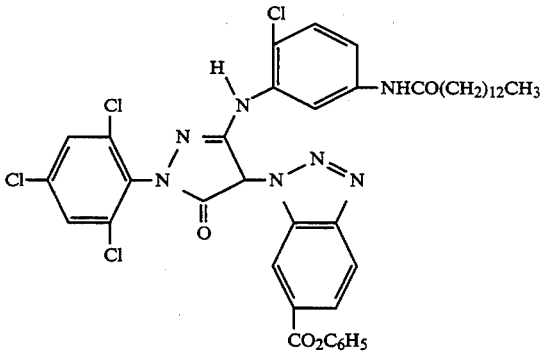

D3

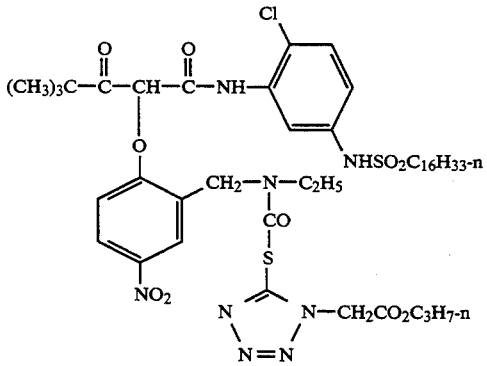

D4

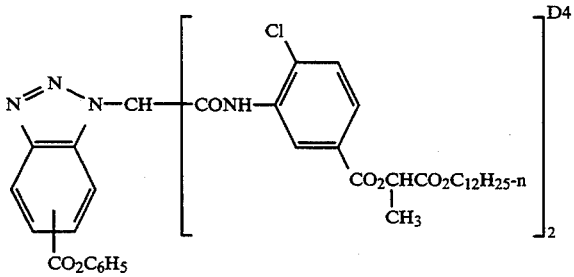

D5

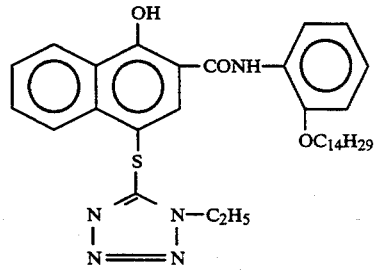

-continued
D6
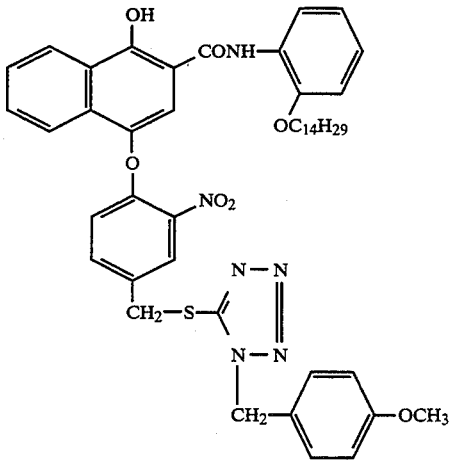
D7
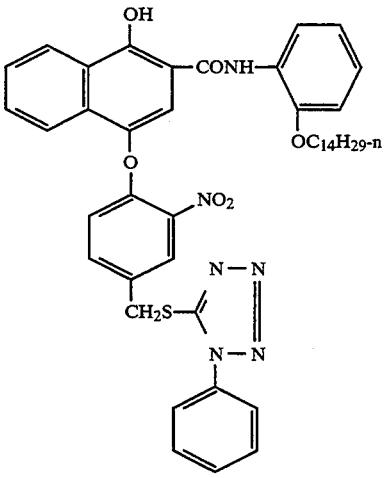
D8
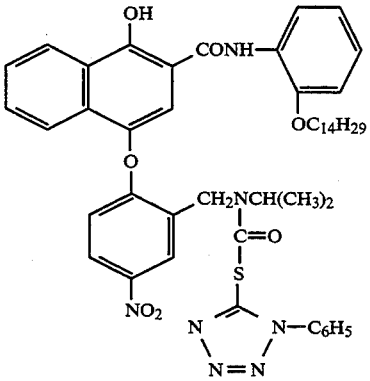
D9
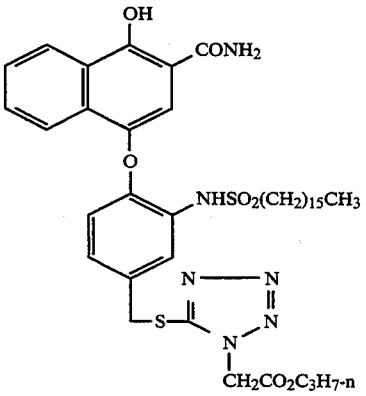

-continued

D10

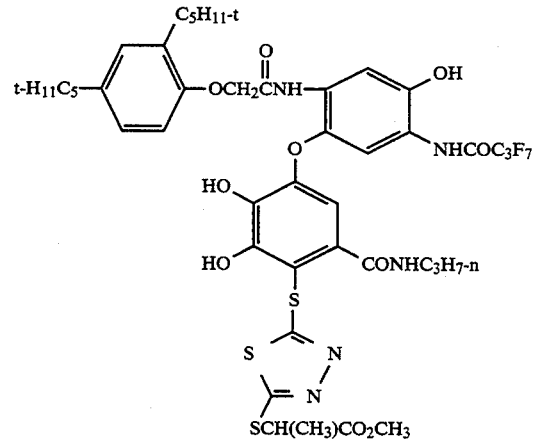

Especially useful in this invention are tabular grain silver halide emulsions. Specifically contemplated tabular grain emulsions are those in which greater than 50 percent of the total projected area of the emulsion grains are accounted for by tabular grains having a thickness of less than 0.3 micron (0.5 micron for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in micrometers and t is the average thickness in micrometers of the tabular grains.

The average useful ECD of photographic emulsions can range up to about 10 micrometers, although in practice emulsion ECD's seldom exceed about micrometers. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin ($t<0.2$ micrometer) tabular grains. To achieve the lowest levels of granularity it is preferred that aim tabular grain projected areas be satisfied with ultrathin ($t<0.06$ micrometer) tabular grains. Tabular grain thicknesses typically range down to about 0.02 micrometer. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micrometer.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

Suitable tabular grain emulsions can be selected from among a variety of conventional teachings, such as those of the following: Research Disclosure, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. The described elements can be processed in the known C-41 color process as described in The British Journal of Photography Annual of 1988, pages 191–198.

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(β-(methanesulfonamido) ethyl)aniline sesquisulfate hydrate, 4-amino-3-methyl-N-ethyl-N-(β-hydroxyethyl)aniline sulfate, 4-amino-3-β-(methanesulfonamido)ethyl-N,N-diethylaniline hydrochloride and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

It is understood thoroughout this specification and claims that any reference to a substituent by the identification of a group containing a substitutable hydrogen (e.g. alkyl, amine, aryl, alkoxy, heterocyclic, etc.), unless otherwise specifically stated, shall encompass not only the substituent's unsubstituted form, but also its form substituted with any photographically useful substituents. Usually the substituent will have less than 30 carbon atoms and typically less than 20 carbon atoms.

The invention is illustrated in the following single layer and multilayer examples.

Single layer photographic elements were prepared by coating a cellulose acetate-butyrate clear film support with gelatin at 3.77 g/m$^2$, a green sensitized silver bromoiodide emulsion at 1.08 g/m$^2$ and a magenta image coupler dispersed as indicated at 0.31 mmol/m$^2$ and, when present, hue correction coupler E (dispersed in its own weight in tricresylphosphate) at 0.14 g/m$^2$ or comparison masking coupler F (dispersed in twice its own weight in tricresylphosphate) at 0.09 g/m2. This layer was then overcoated with a layer containing 2.70 g/m$^2$ of gelatin and bis-vinylsulfonyl methyl ether hardener at 1.75% weight percent based on total gel.

Samples of each element were exposed imagewise through a stepped density test object and subjected to the KODAK FLEXICOLOR (C41) process as described in *British Journal of Photography Annual,* 1988, pp 196–198. Density and spectrophotographic measurements were taken at the indicated wavelength and/or exposure values. The ratio of density at 580 nm to density at 550 nm is a measure of the broadening in the hue. In terms of exposure, low refers to measurements taken at density 0.15 above Dmin, medium at density 1.0 above Dmin and high at maximum density.

COUPLER A

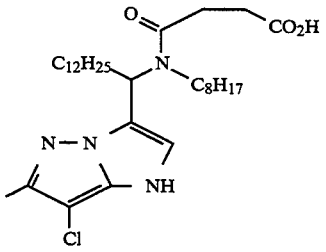

Coupler A was dispersed in 50% its weight in 2,4-bis(1,1-dimethylpropyl)-phenol and 50% its weight in (Z)-9-octadecen-1-ol.

COUPLER B

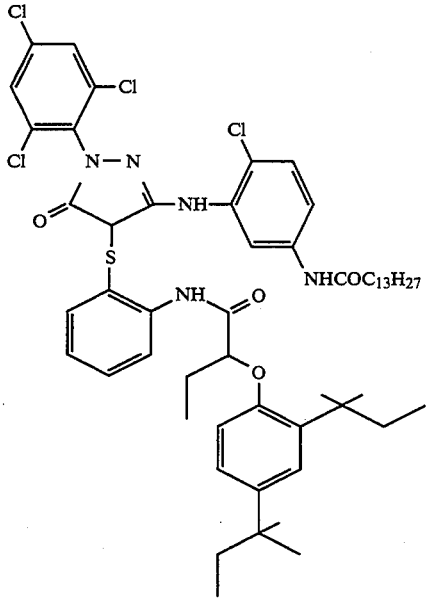

Coupler B was dispersed in 70% of its weight in tricresylphosphate and 30% of N,N-dibutyl-2-butyloxy-5-tert-amylaniline.

COUPLER C

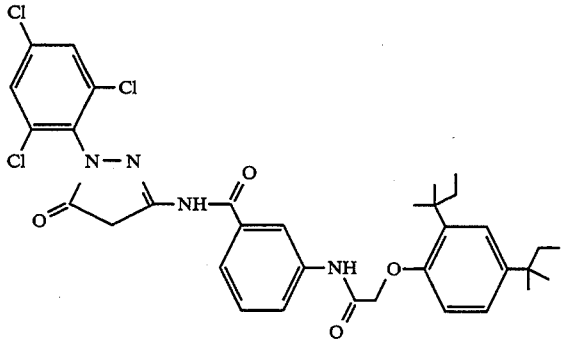

COUPLER D

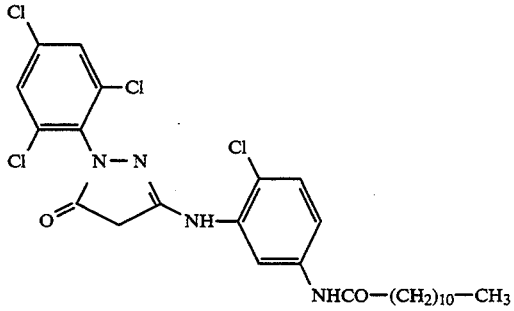

Each of Coupler C and D was dispersed in its own weight in tricresylphosphate.

Inventive Coupler HCC-57

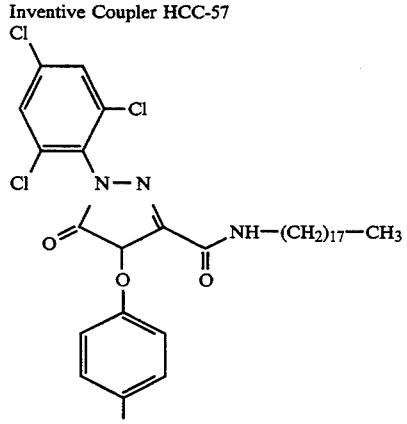

COUPLER F

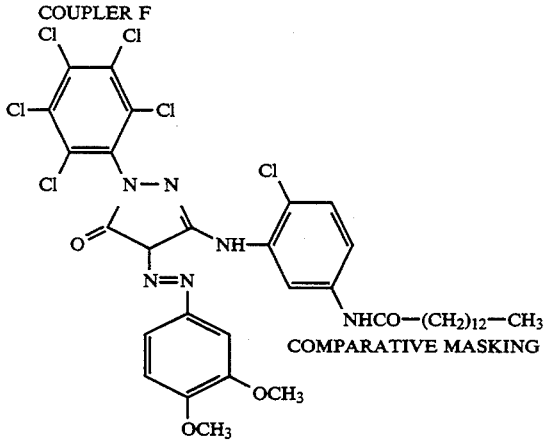

COMPARATIVE MASKING

TABLE I demonstrates that the addition of a hue correction coupler such as Coupler HCC-57 causes the effective hue of its combination with a 1-phenyl-3-anilino-5 pyrazolone coupler (Couplers B or D) be more like a pyrazolotriazole (Coupler A) or a 1-phenyl-3-acylamino-5-pyrazolone (Coupler C) coupler than Couplers B or D alone at 580 nm. This implies that the inventive combination will be seen by printers that read significant amounts of density at 580 nm as being more similar to other classes of broad magenta image dyes. TABLE 2 demonstrates that the hue correction is linear throughout the exposure scale. It is important that the dyes resulting from these hue correction couplers have low absorbance in the red region, as shown by the ratio of red (at 640 nm) to green density (at 550 nm).

TABLE I

HUE COMPARISON OF IMAGE COUPLER COMBINATIONS

| Coupler | Type | $\lambda_{max}$ | HBW | D580/D550 | D640/D550 |
|---|---|---|---|---|---|
| A | Comp | 554 | 107 | .820 | .051 |
| C | Comp | 555 | 98 | .818 | .148 |
| HCC-57 Only | Comp | 589 | 99 | | |
| F Only | Comp | 552 | 89 | | |
| B Only | Comp | 544 | 84 | .485 | .052 |
| B + F | Comp | 543 | 85 | .493 | .050 |
| B + HCC-57 | Inv | 541 | 85 | .530 | .089 |
| D Only | Comp | 544 | 85 | .528 | .060 |
| D + HCC-57 | Inv | 545 | 90 | .612 | .095 |

TABLE II

HUE CORRECTION vs EXPOSURE

| Coupler | $D_{580}/D_{550}$ Low | Medium | High |
|---|---|---|---|
| D Only | .576 | .542 | .528 |
| D + HCC-57 | .635 | .611 | .612 |

COMPARATIVE EXAMPLE 1

A photographic element was produced by coating the following layers on a cellulose triacetate film support (coverage are in grams per meter squared, emulsion sizes as determined by the disc centrifuge method and are reported in Diameter x Thickness in microns);

Layer 1 (Antihalation layer): black collodial silver sol at 0.140; gelatin at 2.15; OxDS-1 at 0.108, DYE-1 at 0.049; DYE-2 at 0.017 and DYE-3 at 0.014.

Layer 2 (Slow cyan layer): a blend of three red sensitized (all with a mixture of RSD-1 and RSD-2) silver iodobromide emulsions: (i) a large sized tabular grain emulsion (1.3×0.118, 4.1 mole % I) at 0.522 (ii) a smaller tabular emulsion (0.85×0.115, 4.1 mole % I) at 0.337 and (iii) a very small tabular grain emulsion (0.55×0.115, 1.5 mole % I) at 0.559; gelatin at 2.85; cyan dye-forming coupler C-1 at 0.452; DIR coupler DIR-1 at 0.043; bleach accelerator releasing coupler B-1 at 0.054 and anti-foggant 4-hydroxy-6-methyl-1,3,3a,7-tetraazaindene at 0.016.

Layer 3 (Fast cyan layer): a red-sensitized (same as above) tabular silver iodobromide emulsion (2.2×0.128, 4.1 mole % I) at 0.086; cyan coupler C-1 at 0.081; DIR-1 at 0.034; MC-1 at 0.043; gelatin at 1.72 and anti-foggant 4-hydroxy-6-methyl-1,3,3a,7-tetraazaindene at 0.010.

Layer 4 (Interlayer): gelatin at 1.29.

Layer 5 (Slow magenta layer): a blend of two green sensitized (both with a mixture of GSD-1 and GSD-2) silver iodobromide emulsions: (i) 0.54×0.091, 4.1 mole % iodide at 0.194 and (ii) 0.52×0.085, 1.5 mole % iodide at 0.559; magenta dye forming coupler B at 0.258; gelatin at 1.08 and anti-foggant 4-hydroxy-6-methyl-1,3,3a,7-tetraazaindene at 0.005.

Layer 6 (Mid magenta layer): a blend of two green sensitized (same as above) tabular silver iodobromide emulsions (i) 1.3×0.113, 4.1 mole % I at 0.430 and (ii) 0.54×0.91, 4.1 mole % I at 0.172; Coupler B at 0.086; MC-2 at 0.015; DIR-2 at 0.016; gelatin at 2.12 and anti-foggant 4-hydroxy-6-methyl-1,3,3a,7-tetraazaindene at 0.003.

Layer 7 (Fast magenta layer): a green sensitized tabular silver iodobromide (1.8×0.127, 4.1 mole % I) emulsion at 0.689; gelatin at 1.61; Coupler B at 0.059; MC-2 at 0.054 and DIR-3 at 0.003.

Layer 8 (Yellow filter layer): gelatin at 0.86; Carey-Lea silver at 0.043 and OxDS-2 at 0.054.

Layer 9 (Slow yellow layer): an equal blend of three blue sensitized (both with YSD-1) tabular silver iodobromide emulsions (i) 0.50×0.085, 1.5 mole % I (ii) 0.60 diameter, 3% mole I and (iii) 0.68 diameter, 3 mole % I at a total of 0.430; yellow dye forming coupler Y-1 at 0.699; Y-2 at 0.215; DIR-4 at 0.086; C-1 at 0.097 and gelatin at 2.066.

Layer 10 (Fast yellow layer): two blue sensitized (with YSD-1) tabular silver iodobromide emulsions (i) 3.1×0.137, 4.1 mole % I at 0.396 (ii) 0.95 diameter, 7.1 mole % I at 0.47; Y-1 at 0.131; Y-2 at 0.215; DIR-4 at 0.075; C-1 at 0.011; B-1 at 0.008 and gelatin at 1.08.

Layer 11 (Protective overcoat and UV filter layer): gelatin at 1.61; silver bromide Lippman emulsion at 0.215; UV-1 and UV-2 (1:1 ratio) at a total of 0.023 and bis(vinylsulfonyl)methane hardener at 1.6% of total gelatin weight.

Surfactants, coating aids, emulsion addenda, sequestrants, lubricants, matte and tinting dyes were added to the appropriate layers as is common in the art.

This example represents a multilayer film with a 1-phenyl-3-anilino-5-pyrazolone magenta image coupler that has relatively low density at 565–600 nm.

COMPARATIVE EXAMPLE 2

Example 2 was prepared in a similar manner as Example 1, except that Coupler B in layer 5, 6 and 7 was replaced with Coupler A at 0.226, 0.077 and 0.048, respectively.

This example represents a multilayer film with a pyrazolotriazole magenta image coupler that has high density at 565–600 nm.

COMPARATIVE EXAMPLE 3

Example 3 was prepared in a similar manner as Example 1, except that DYE-2 in Layer 1 was relaced by DYE-4 at 0.43.

This example represents a multilayer film that contains a photographically inert dye.

INVENTIVE EXAMPLE 4

Example 4 was prepared in a similar manner to Example 1 except that Coupler HCC-57 replaced Coupler B in Layer 5 at the same laydown.

DYE-1:

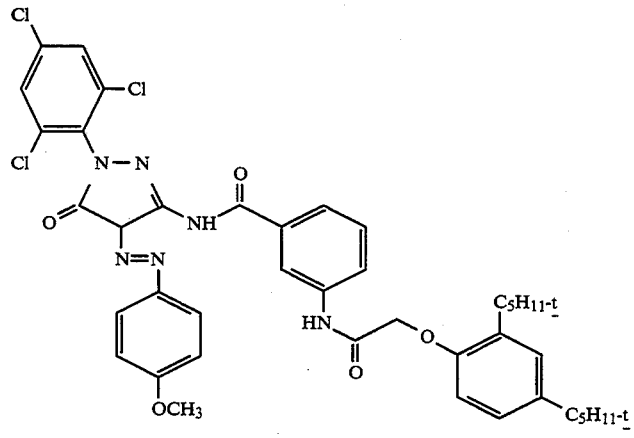

DYE-2:

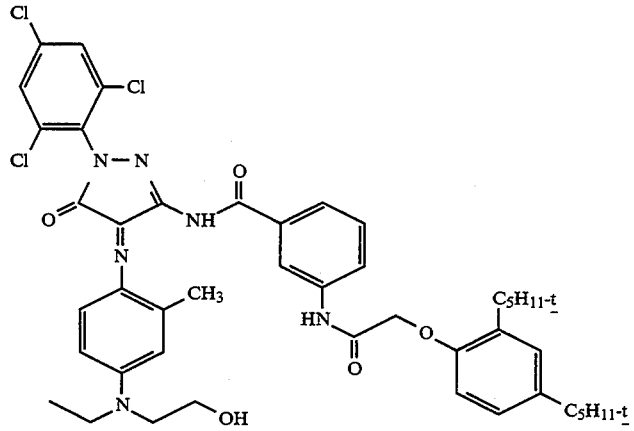

DYE-3:

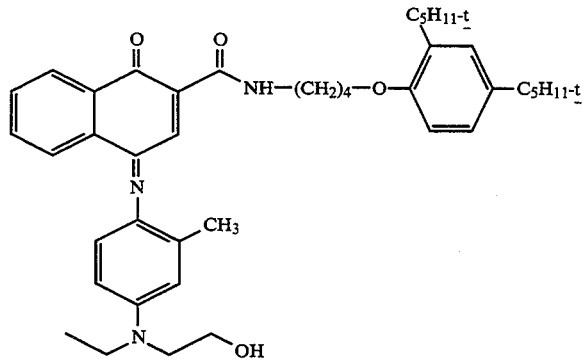

-continued
DYE-4:
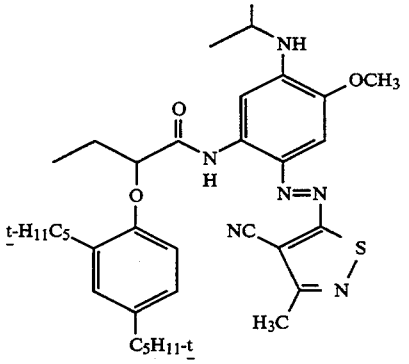
C-1:
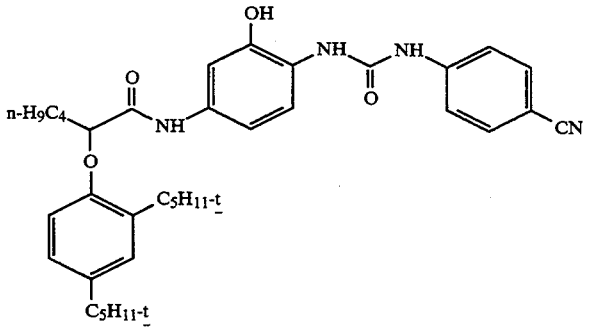
Y-1:
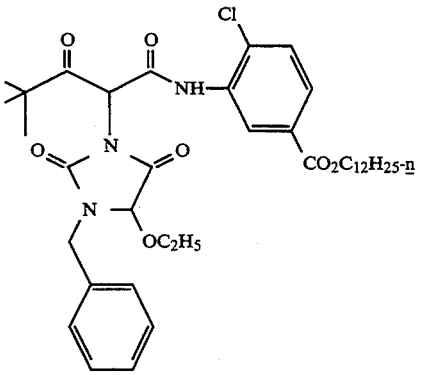
C-1:
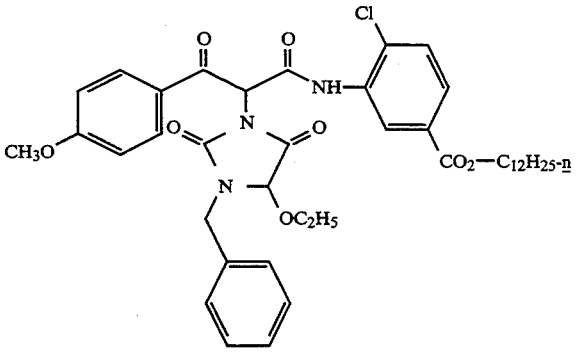

-continued
DIR-1:
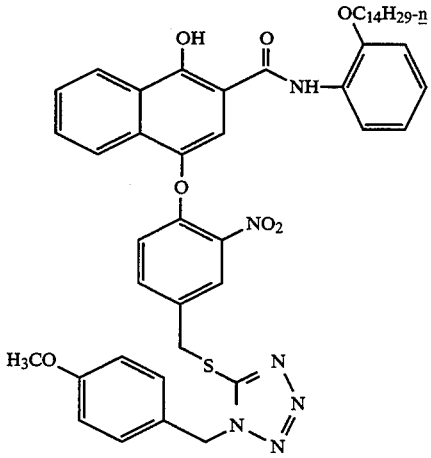
DIR-2:
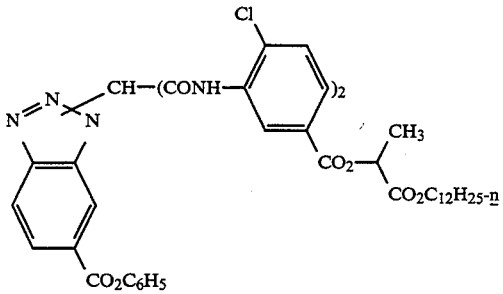
DIR-3:
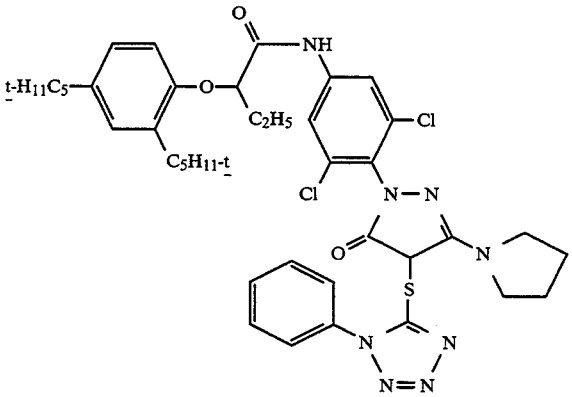
DIR-4:
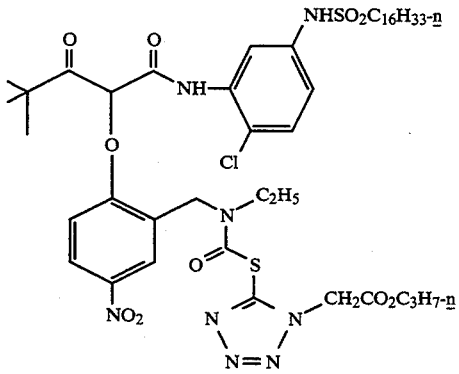

-continued
MC-1:
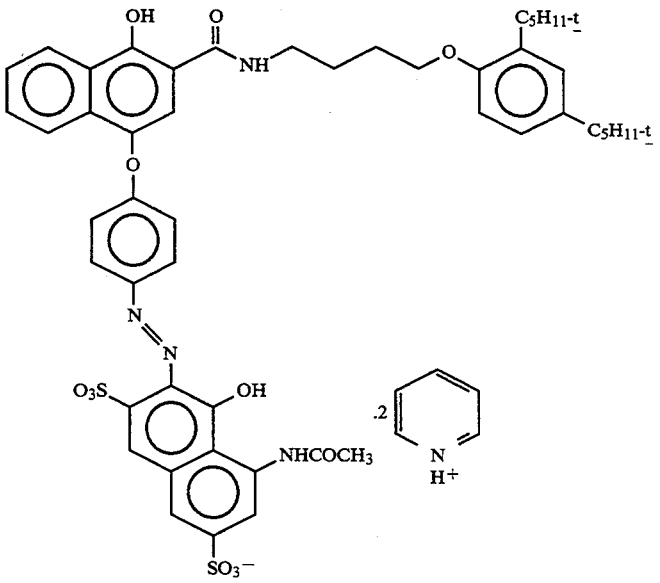
MC-2:
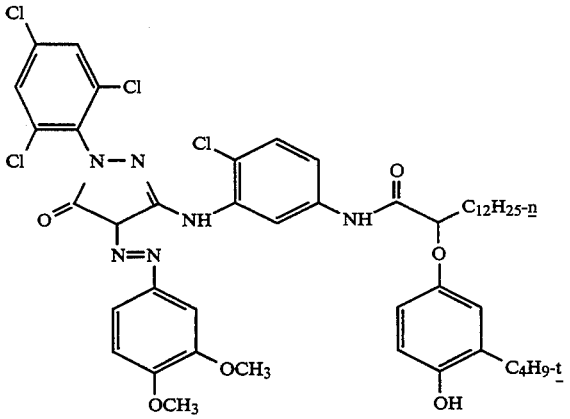
B-1:
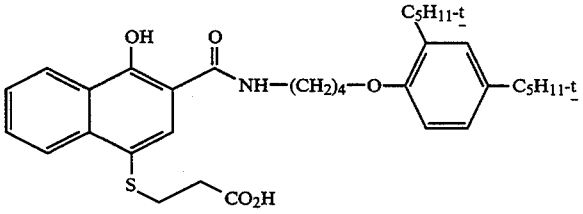
OxDS-1:
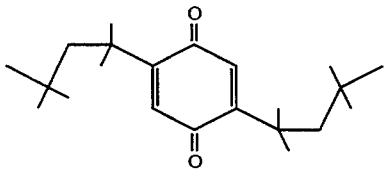
OXDS-2:
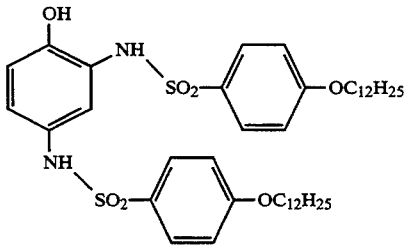

-continued
UV-1:
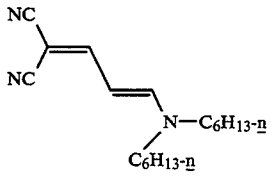
UV-2:
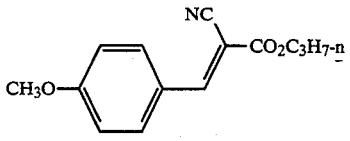
RSD-1:
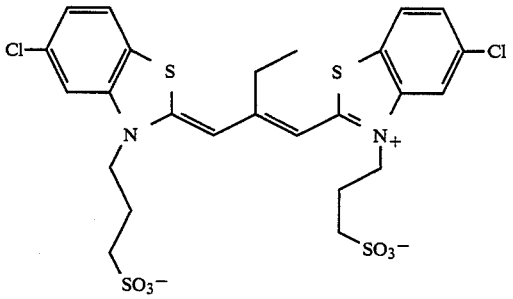
RSD-2:
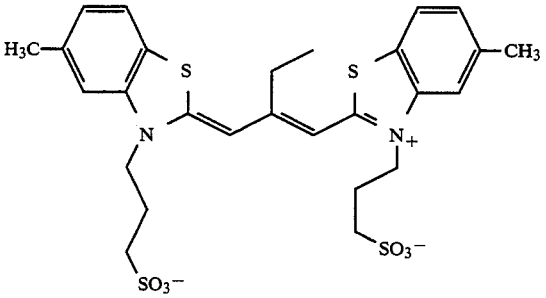
GSD-1:
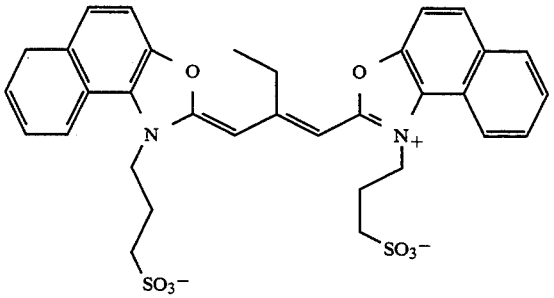
GSD-2:
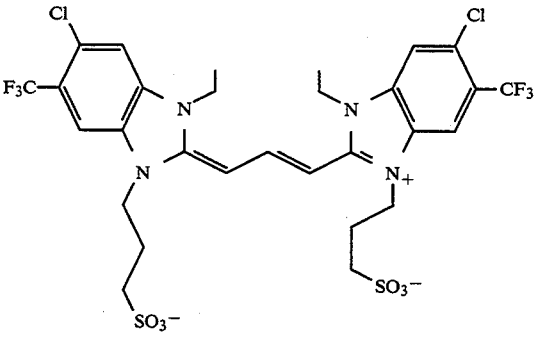

-continued

BSD-1:

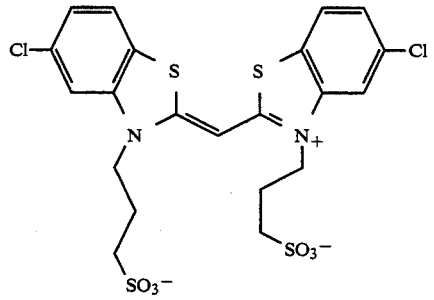

These multilayer film elements were given a stepped neutral exposure and processed as described for the single layers.

TABLE III

HUE CORRECTION COUPLER IN MULTILAYER FORMAT

| Example | Type | $D_{580}/D_{550}$ Low | Mid | High |
|---|---|---|---|---|
| 1 | Comp | .730 | .687 | .643 |
| 2 | Comp | .749 | .713 | .722 |
| 3 | Comp | .770 | .739 | .693 |
| 4 | Inv | .750 | .712 | .750 |

Table 3 clearly demonstrates that a film containing a pyrazolone magenta image coupler in the green sensitive layer has less density at 580 nm relative to density at 550 nm, than does a film containing a pyrazolotriazole coupler. Thus, printers that read significant amounts of density at greater than 565 nm would measure the films of Example 1 or 2 as having different amounts of green density even though they have the same amount of green density at 550 nm. Hence, such printers would use different amounts of correction in the subsequent exposure of photographic paper and the resulting prints would differ in color balance. Example 3, which contains an inert dye, has increased density at 580 nm relative to 550 nm, but the effect is not linear throughout the exposure scale. However, Example 4, which contains the hue correction coupler, has increased density at 580 nm relative to 550 nm throughout the exposure scale thereby making such a film appear more like a film of Example 2 even in a wide range of printers (particulary those that read significant green density above 565 nm).

Experiments with an AGFA MSP printer, which reads significant amounts of green density above 565 nm, showed that Example 4 was closer to Example 2 in red, green and blue response than either Examples 1 or 3 and produced color prints that were more alike throughout the scale to Example 2 than either Examples 1 or 3.

The present invention has been described in detail with particular reference to preferred embodiments, but it will be understood that variations and modifications can be effected within the spirit and the scope of the invention.

What is claimed is:

1. A silver halide color negative photographic element comprising a red sensitive silver halide emulsion layer containing a coupler with reacts with oxidized color developer to form a cyan dye, a blue sensitive silver halide emulsion layer containing a coupler which reacts with oxidized color developer to form a yellow dye, and a green sensitive silver halide emulsion layer containing a coupler which upon reaction with oxidized color developer forms a magenta image dye, the element additionally comprising a hue correction coupler associated with said green sensitive layer which hue correction coupler reacts with oxidized developer to form a dye having a peak absorption between 565–600 nm so that the element has a D580/D550 ratio which is greater than that exhibited by the element absent the hue correction coupler.

2. A photographic element according to claim 1 wherein the element, absent the hue correction coupler, has a D580/D550 at neutral midscale exposure of 0.75 or less.

3. A photographic element according to claim 1 wherein the element, absent the hue correction coupler dye, has a D580/D550 at neutral midscale exposure of 0.65 or less.

4. A photographic element according to claim 1 wherein the hue correction coupler increases D580/D550 of the element at neutral midscale exposure by at least 0.01.

5. A photographic element according to claim 1 wherein the hue correction coupler increases D580/D550 of the element at neutral midscale exposure by at least 0.05.

6. A photographic element according to claim 4 wherein any increase in D640/D550 of the element at neutral midscale exposure caused by the hue correction coupler is less than the amount the hue correction coupler increases D580/D550 of the element at neutral midscale exposure.

7. A silver halide color negative photographic element comprising a red sensitive layer containing a coupler which reacts with oxidized color developer to form a cyan dye, a blue sensitive layer containing a coupler which reacts with oxidized color developer to form a yellow dye, and a green sensitive layer containing a 1-phenyl-3-anilino-5-pyrazolone coupler which upon reaction with oxidized color developer forms a magenta image dye, the element additionally comprising a hue correction coupler associated with a green sensitive layer which hue correction coupler reacts with oxidized developer to form a dye having a peak absorption between 565–600 nm so that the negative has a D580/D550 ratio which is greater than that exhibited by the element absent the hue correction coupler.

8. A photographic element according to claim 7 wherein the element, absent the hue correction coupler, has a D580/D550 at neutral midscale exposure of 0.75 or less.

9. A photographic element according to claim 7 wherein the element, absent the hue correction coupler has a D580/D550 at neutral midscale exposure of 0.65 or less.

10. A photographic element according to claim 7 wherein the hue correction coupler increases D580/D550 of the element at neutral midscale exposure by at least 0.01 compared to the same element absent the hue correction coupler.

11. A photographic element according to claim 7 wherein the hue correction coupler increases D580/D550 of the element at neutral midscale exposure by at least 0.05 compared to the same element absent the hue correction coupler.

12. A photographic element according to claim 10 wherein any increase in D640/D550 of the element at neutral midscale exposure caused by the hue correction coupler, is less than the amount the hue correction coupler increases D580/D550 of the element at neutral midscale exposure.

13. A photographic element according to claim 7 wherein the hue correction coupler is located in a green sensitive layer of the element.

14. A photographic element according to claim 7 wherein the hue correction coupler is located in the least green sensitive layer when two or more green sensitive layers are present.

15. A silver halide color negative photographic element comprising:

a red sensitive layer containing a coupler which reacts with oxidized color developer to form a cyan dye, a blue sensitive layer containing a coupler which reacts with oxidized color developer to form a yellow dye, and a green sensitive layer containing a coupler which upon reaction with oxidized color developer forms a magenta dye, the magenta dye-forming coupler being of the formula (M):

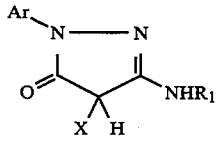

(M)

Ar is an unsubstituted aryl group or an aryl group substituted with one or more substituents selected from halogen atoms and cyano, alkylsulfonyl, arylsulfonyl, sulfamoyl, sulfonamido, carbamoyl, carbonamido, alkoxy, acyloxy, aryloxy, alkoxycarbonyl, aryloxycarbonyl, ureido, nitro, alkyl, and trifluoromethyl, or Ar is an aryl group substituted with a group which forms a link to a polymeric chain;

$R_1$ is a substituted or unsubstituted phenyl group, the $R_1$ substituents being individually selected from halogen atoms, and alkyl, aryl, alkoxy, aryloxy, carbonamido, carbamoyl, sulfonamido, sulfamoyl, alkylsulfinyl, arylsulfinyl, alkylsulfonyl, arylsulfonyl, alkoxycarbonyl, aryloxycarbonyl, acyl, acyloxy, ureido, imido, carbamate, heterocyclic, cyano, trifluoromethyl, alkylthio, nitro, carboxyl and hydroxyl groups, provided that $R_1$ contains at least 6 carbon atoms or the $R^1$ substituents may individually comprise a group which forms a link to a polymeric chain;

X is hydrogen or a coupling-off group selected from the group consisting of halogens, alkoxy, aryloxy, alkylthio, arylthio, acyloxy, sulfonamido, carbonamido, arylazo, nitrogen-containing heterocyclic and imido groups; and the element additionally comprising a hue correction coupler associated with a green sensitive layer which reacts with oxidized developer to form a dye having a peak absorption between 565–600 nm so that the element has a D580/D550 ratio at neutral midscale exposure which is greater than exhibited by the element absent the hue correction coupler.

16. A photographic element according to claim 15 in which Ar is of the structure:

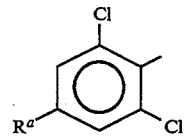

wherein $R^a$ is selected from the group consisting of halogen, cyano, alkylsulfonyl, arylsulfonyl, sulfamoyl, sulfonamido, carbamoyl, carbonamido, ureido, atkoxycarbonyl, aryloxycarbonyl, acyloxy, alkoxy, aryloxy, nitro and trifluoromethyl groups;

—$NHR_1$ is of the structure:

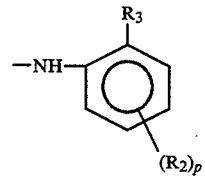

wherein p is from zero to 2 and each $R_2$ is in a meta or para position with respect to $R_3$;

each $R_2$ is individually selected from the group consisting of halogen, alkyl, alkoxy, aryloxy, carbonamido, carbamoyl, sulfonamido, sulfamoyl, alkylsulfinyl, arylsulfinyl, alkylsulfonyl, arylsulfonyl, alkoxycarbonyl, aryloxycarbonyl, acyloxy, ureido, imido, carbamate, heterocyclic, cyano, nitro, acyl, trifluoromethyl, alklythio and carboxyl groups; and $R_3$ is selected from the group consisting of hydrogen, halogen, alkyl, alkoxy, aryloxy, alkylthio, carbonamido, carbamoyl, sulfonamido, sulfamoyl, alkylsulfonyl, arylsulfonyl, alkoxycarbonyl, acyloxy, acyl, cyano, nitro and trifluoromethyl groups; and X is of the structure:

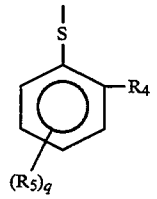

wherein $R_4$ and $R_5$ are individually selected from the group consisting of hydrogen, halogen, alkyl, alkoxy, aryloxy, carbonamido, ureido, carbamate, sulfonamido, carbamoyl, sulfamoyl, acyloxy, alkoxycarbonyl, aryloxycarbonyl, amino and carboxyl groups, and wherein q is 0, 1 or 2 and $R_5$ may be in the meta or para position with respect to the sulfur atom.

17. A photographic element according to claim 15 wherein the hue correction coupler has a formula selected from formulas I, II, III, IV, V, VI and VII:

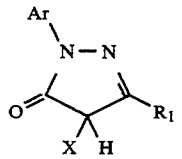

(I)

where:

Ar is a unsubstituted aryl group or an aryl group substituted wit one or more substituents selected from halogen atoms and cyano, alkylsulfonyl, arylsulfonyl, sulfamol, sulfonamido, carbamoyl, carbonamido, alkoxy, acyloxy, aryloxy, alkoxycarbonyl, aryloxycarbonyl, ureido, nitro, alkyl, and trifluoromethyl, or Ar is an aryl group substituted with a group which forms a link to a polymeric chain;

$R_1$ is any substituent with a para Hammett constant value ($\sigma_p$) of zero or greater;

X is a hydrogen atom or any coupling-off group known in the art;

and wherein the combination of Ar and $R_1$ are chosen to give a dye with $\lambda_{max}$ of 565–600 nm after development;

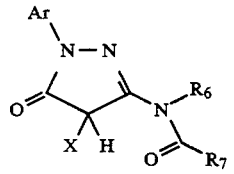

(II)

where Ar and X are as previously defined for Formula (I);

$R_6$ is a unsubstituted or substituted alkyl or phenyl group the substituents of $R_6$ being individually selected from halogen atoms, and alkyl, aryl, alkoxy, aryloxy, carbonamido, carbamoyl, sulfonamido, sulfamoyl, alkylslfinyl, arylsulfinyl, alkylsulfonyl, arylsulfonyl, alkoxycarbonyl, aryloxycarbonyl, acyl, acyloxy, ureido, imido, carbamate, heterocyclic, cyano, trifluoromethyl, alkylthio, nitro, carboxyl and hydroxyl groups, provided that $R_6$ contains at least 6 carbon atoms or the $R_6$ substitutents may individually comprise a group which forms a link to a polymeric chain;

$R_7$ is an alkyl, alkoxy, aryl, aryloxy or amino group;

and wherein the combination of Ar and $R_6$ are chosen to give a dye with $\lambda_{max}$ of 565–600 nm after development;

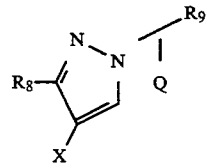

(III)

where:

X is as defined previously for Formula (I);

Q represents a group of non-metallic atoms necessary to form a nitrogen containing heterocyclic ring which has a substituent $R_9$;

$R_8$ and $R_9$ are either an alkyl or aryl group or any substituent with a para Hammett constant value ($\sigma_p$) of zero or greater;

at least one of $R_8$ or $R_9$ is either a phenyl group or a substituent with a para Hammett constant value ($\sigma_p$) of zero or greater and together provide a dye with $\lambda_{max}$ of 565–600 nm after development;

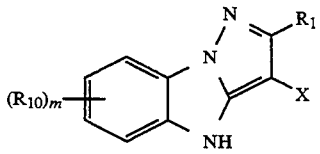

(IV)

where:

X and $R_1$ are as defined previously;

$R_{10}$ is selected from the same group as $R_1$; and m is 0–5;

with the proviso that the substituents are chosen as to provide a dye with peak absorbency of 565 nm–600 nm after development;

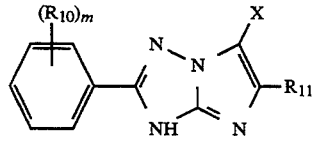

(V)

where:

$R_{10}$, m, and X are as previously defined;

$R_{11}$ is selected from the group consisting of alkyl, alkyloxy, acylamino, amino, and aryl;

with the proviso that the substituents are chosen as to provide a dye with peak absorbency of 565 nm–600 nm after development.

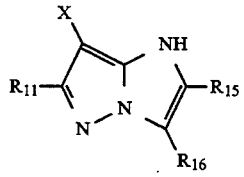

(VI)

where;

X and $R_{11}$ as defined previously;

$R_{15}$ and $R_{16}$ are each individually hydrogen or a substituent as defined for $R_{11}$ or may be joined together to form a ring system; and with the proviso that the substituents are chosen as to provide a dye with peak absorbency of 565 nm–600 nm after development;

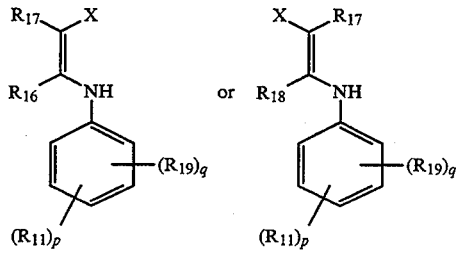

(VII)

where:

X and $R_{11}$ are as previously defined;

$R_{17}$ and $R_{18}$ are each independently from the same group as $R_1$;

$R_{19}$ is a substituent with a para Hammett sigma constant value of at least 0.3;

q is 1–5 and p is 0–4 such that (q+p) is less than or equal to 5; and wherein the substituents are chosen as to provide a dye with $\lambda_{max}$ of 565–600 nm after development.

18. A photographic element according to claim 15 wherein the image coupler level in said green-sensitive layer is 0.01 to 5 g/m$^2$ and the hue correction coupler level is 0.0002 to 5 g/m$^2$.

19. A photographic element according to claim 15 wherein said green sensitive layer contains the image coupler level at a laydown of 0.02 to 2 g/m$^2$ and the hue correction coupler level at a laydown or 0.001 to 2 g/m$^2$.

20. A photographic element according to claim 15 wherein the laydown of the image dye-forming coupler in said green sensitive layer is 0.05 to 1 g/m$^2$ and of the hue correction coupler is 0.01 to 1 g/m$^2$.

21. A photographic element according to claim 15 wherein the element, absent the hue correction coupler, has a D580/D550 at neutral midscale exposure of 0.75 or less.

22. A silver halide photographic element according to claim 15 wherein the element, absent the hue correction coupler, has D580/D550 at neutral midscale exposure of 0.65 or less.

23. A silver halide photographic element according to claim 15 wherein the hue correction coupler increases $D_{580}$/D550 of the element at neutral midscale exposure by at least 0.01 compared to the same element absent the hue correction coupler.

24. A silver halide photographic element according to claim 15 wherein the hue correction coupler increased D580/D550 of the element at neutral midscale exposure by at least 0.05 compared to the same element absent the hue correction coupler.

25. A silver halide photographic element according to claim 15 wherein the hue correction coupler has the following structure:

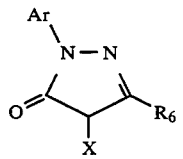

where X and Ar are as defined in claim 15 and $R_6$ is a substitutent with para Hammett sigma constant of greater than zero.

* * * * *

UNITED STATES PATENT AND TRADEMARK OFFICE

CERTIFICATE OF CORRECTION

PATENT NO. : 5,447,831

DATED : September 5, 1995

INVENTOR(S) : Stephen P. Singer, et al

It is certified that error appears in the above-indentified patent and that said Letters Patent is hereby corrected as shown below:

Col. 56, line 23, please delete "atkox" and insert --alkox---

Col. 57, line 16, please delete "wit" and insert --with--

Col. 57, line 46, please delete "alkylslfinyl" and insert --alkylsulfinyl--

Col. 57, structure (III) please delete the following:

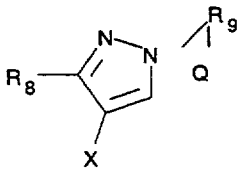

and insert the following:

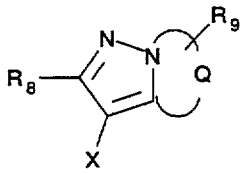

UNITED STATES PATENT AND TRADEMARK OFFICE

CERTIFICATE OF CORRECTION

PATENT NO. : 5,447,831

DATED : September 5, 1995

INVENTOR(S) : Stephen P. Singer, et al

It is certified that error appears in the above-indentified patent and that said Letters Patent is hereby corrected as shown below:

Col. 59, line 5, structure (VII) please delete:

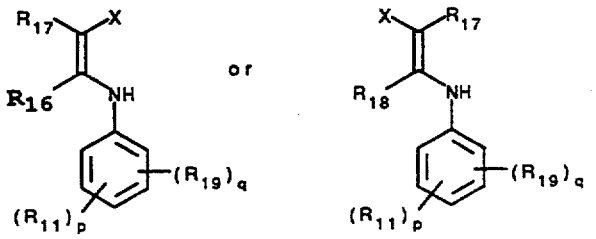

(VII)

and insert:

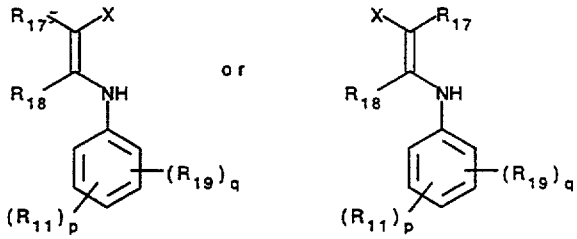

(VII)

UNITED STATES PATENT AND TRADEMARK OFFICE

CERTIFICATE OF CORRECTION

PATENT NO. : 5,447,831

DATED : September 5, 1995

INVENTOR(S) : Stephen P. Singer, et al

It is certified that error appears in the above-indentified patent and that said Letters Patent is hereby corrected as shown below:

Col 60, line 13, please delete "$D_{580}$" and insert --D580--.

Col. 60, line 18, please delete "creased" and insert --creases--.

Signed and Sealed this

Thirtieth Day of July, 1996

*Attest:*

*Attesting Officer*

BRUCE LEHMAN

*Commissioner of Patents and Trademarks*